US008014708B2

(12) United States Patent
Sawai

(10) Patent No.: US 8,014,708 B2
(45) Date of Patent: Sep. 6, 2011

(54) BELT MEMBER, TRANSFER UNIT INCORPORATING SAME, IMAGE FORMING APPARATUS INCORPORATING SAME, AND METHOD OF EVALUATING SAME

(75) Inventor: Yuuji Sawai, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 314 days.

(21) Appl. No.: 12/329,127

(22) Filed: Dec. 5, 2008

(65) Prior Publication Data

US 2009/0148201 A1 Jun. 11, 2009

(30) Foreign Application Priority Data

Dec. 6, 2007 (JP) ..... 2007-316230

(51) Int. Cl.
*G03G 15/01* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS

| | | | | |
|---|---|---|---|---|
| 5,655,200 | A * | 8/1997 | Oyama | 399/313 |
| 6,173,148 | B1 | 1/2001 | Matsuda et al. | |
| 6,611,672 | B2 | 8/2003 | Aoki et al. | |
| 6,618,565 | B2 | 9/2003 | Tamiya et al. | |
| 6,741,821 | B2 | 5/2004 | Sugino et al. | |
| 6,768,892 | B2 | 7/2004 | Sawai | |
| 6,823,149 | B2 | 11/2004 | Yoshikawa et al. | |
| 6,829,450 | B2 | 12/2004 | Tamiya et al. | |
| 6,885,842 | B2 | 4/2005 | Sawai | |
| 6,901,234 | B2 | 5/2005 | Ogiyama et al. | |
| 7,003,238 | B2 | 2/2006 | Yoshida et al. | |
| 7,174,124 | B2 | 2/2007 | Ishibashi et al. | |
| 7,277,662 | B2 | 10/2007 | Sawai et al. | |
| 7,280,792 | B2 | 10/2007 | Sawai et al. | |
| 7,346,287 | B2 | 3/2008 | Ogiyama et al. | |
| 2003/0118359 | A1 | 6/2003 | Ogiyama et al. | |
| 2003/0123911 | A1 * | 7/2003 | Kayahara et al. | 399/297 |
| 2006/0056884 | A1 | 3/2006 | Sawai et al. | |
| 2006/0240248 | A1 * | 10/2006 | Kanai | 428/336 |

(Continued)

FOREIGN PATENT DOCUMENTS

| | | |
|---|---|---|
| JP | 11-282277 | 10/1999 |

(Continued)

OTHER PUBLICATIONS

English translation of Hara JP 2004-287383.*

*Primary Examiner* — Ryan D Walsh
(74) *Attorney, Agent, or Firm* — Oblon, Spivak, McClelland, Maier & Neustadt, L.L.P.

(57) ABSTRACT

A multi-layer endless belt member with a high-resistance surface layer for use in an image forming apparatus. A volume resistivity thereof ranges from approximately 8.0 to approximately 11.0 in log [Ω·cm]. An amount of resistivity change of a first surface thereof is greater than an amount of resistivity change of a second surface thereof by 0.05 or greater in log [Ω/square], where the amount of resistivity change of the first surface indicates a difference between surface resistivity values measured after a given voltage is applied for 1 second and for 100 seconds on the first surface thereof and the amount of resistivity change of the second surface indicates a difference between surface resistivity values measured after a given voltage is applied for 1 second and for 100 seconds on the second surface thereof.

13 Claims, 10 Drawing Sheets

U.S. PATENT DOCUMENTS

| | | | |
|---|---|---|---|
| 2007/0134029 | A1 | 6/2007 | Sawai |
| 2007/0269241 | A1 | 11/2007 | Sawai et al. |
| 2007/0280749 | A1 | 12/2007 | Sawai |
| 2008/0003024 | A1 | 1/2008 | Sawai |

FOREIGN PATENT DOCUMENTS

| | | |
|---|---|---|
| JP | 2003-268209 | 9/2003 |
| JP | 2004-184875 | 7/2004 |
| JP | 2004-287383 | 10/2004 |

* cited by examiner

BELT MEMBER, TRANSFER UNIT INCORPORATING SAME, IMAGE FORMING APPARATUS INCORPORATING SAME, AND METHOD OF EVALUATING SAME

CROSS-REFERENCE TO RELATED APPLICATIONS

The present invention claims priority pursuant to 35 U.S.C. §119 from Japanese Patent Application No. 2007-316230, filed on Dec. 6, 2007 in the Japan Patent Office, the contents and disclosures of which are hereby incorporated by reference herein in their entirety.

BACKGROUND OF THE INVENTION

1. Field of the Invention

Exemplary embodiments of the present invention generally relate to a belt member, a transfer unit including the belt member, an image forming apparatus including the belt member, and a method of evaluating the belt member.

2. Discussion of the Related Art

Full-color image forming apparatuses for electrophotographic printing generally perform either a direct transfer operation or an indirect transfer operation. In the indirect transfer operation, a toner image formed on an image carrier that contacts a belt is transferred onto an outer circumferential surface of the belt in an electric field supplied by a transfer bias unit, in an operation that is referred to as primary transfer. Then, the toner image retained by the belt is transferred onto a transfer member or a recording medium conveyed along the outer circumferential surface of the belt, in an operation referred to as secondary transfer. Through the primary and secondary transfers, ultimately a full-color toner image is formed on a recording medium.

For an image forming apparatus to perform the above-described primary and secondary transfers, a belt or an intermediate transfer belt having medium-resistance in volume resistivity is commonly employed. Such a medium-resistance intermediate transfer belt is cost-effective since it is generally used without a belt charge eliminator for eliminating residual charge remaining on the intermediate transfer belt.

When such an intermediate transfer belt having medium resistance is used for image forming, the transfer bias applied for primary transfer charges an outer circumferential surface of the intermediate transfer belt to a given electric potential. Soon, the charge forming the electric potential is gradually bled from the intermediate transfer belt via supporting rollers that serve as supporting means contacting an inner circumferential surface of the intermediate transfer belt, and thus the electric potential of the intermediate transfer belt decreases to close to 0V. Thus, the intermediate transfer belt having medium resistance does not hold residual charge, and therefore irregularities such as afterimage caused by residual charge can be prevented.

By contrast, an intermediate transfer belt having high resistance can hold an electric potential that is created during one primary transfer until a subsequent primary transfer. In this case, it is difficult to form a desired electric field in the subsequent primary transfer due to the presence of residual charge on the intermediate transfer belt. Accordingly, the electric field in the subsequent primary transfer may be different from that in the previous primary transfer, and therefore an intermediate transfer member having high resistance may need to be used with a belt charge eliminator, addition of which can cause an increase in the cost of an image forming apparatus.

As the electric potential on the medium resistance intermediate transfer belt decreases close to 0V, an electric potential at a portion of the intermediate transfer belt that corresponds to a background portion of an image, where no toner image is formed, and an electric potential at a portion of the intermediate transfer belt where a toner image is formed may differ significantly. This is because, when a color toner image is formed by sequentially superimposing single-color toner images on top of each other, the electric potential of toner on a surface of the color toner image may be high, and as a result the charged toner image (more precisely, the charged toner particles) may be attracted to the outer circumference of the intermediate transfer belt due to localized differences in potential. As a result, some toner particles on the color toner image may scatter to the outer circumference of the intermediate transfer belt, which can adversely affect image quality.

The above-described toner scattering is particularly noticeable in full-color image forming and is regarded as one of the causes of image deterioration or irregularity, such as image background contamination and ink bleed on text.

Further, the medium resistance intermediate transfer belt has low electrical withstand voltage. Therefore, when a toner image is transferred at a secondary transfer nip from the intermediate transfer belt to a recording medium, spot-like discharges may occur in the secondary transfer nip that generate hollow defects or white spots on the toner image transferred onto the recording medium. Particularly with low ambient humidity, high resistance for duplex copy, and high voltage for the secondary transfer, hollow defects or white spots can appear on the toner image.

For example, one conventional image forming apparatus includes a multi-layer intermediate transfer belt composed of a high-resistance surface layer that forms an outer circumferential surface for carrying a toner image thereon and a medium-resistance base layer that forms an inner circumferential surface of the multi-layer intermediate transfer belt to which a transfer bias is applied. Such a high-resistance surface layer can provide high charge retention, which can reduce a potential difference between a surface potential of the multi-layer intermediate transfer belt and a charged potential of toner attracted to the outer circumference of the intermediate transfer belt. Thus, the above-described toner scattering can be reduced, thereby preventing a decrease in image quality in development.

Further, the high-resistance surface layer can increase the electrical withstand voltage of the multi-layer intermediate transfer belt, and as a result, the spot-like discharge in the secondary transfer nip can be prevented to avoid white defects in images.

However, a drawback of the conventional composite belt having a high-resistance surface layer and a medium-resistance base layer is that, while good charge retention to prevent toner scattering can be obtained, the electrical withstand voltage is not sufficient to prevent occurrence of the spot-like discharge to produce an image with white spots.

Generally, a composite belt having a high-resistance surface layer on top of a medium-resistance base layer is manufactured to have a given tolerance. The upper and lower limits of the tolerance are determined not only by the belt's quality but also by its manufacturability, such as mass productivity. Therefore, even within the tolerance, the composite belt may have deviations in quality. Therefore, a final determination of such a composite belt is generally made according to a test of characteristics of the composite belt.

However, when testing to evaluate the characteristics of the surface layer of the composite belt, the evaluation is generally made on the basis of the combined characteristics of the base layer and the surface layer. Therefore, it is probable that the evaluation cannot accurately evaluate the characteristics of only the surface layer of the composite belt.

For example, FIG. 1 shows changes in surface resistivity of two test composite belts. A surface resistance of a belt is generally determined according to a resistance measured over an arbitrary period of time, e.g., 10 seconds. However, as shown in FIG. 1, while the surface resistivities of Belt A and Belt B are substantially equal to each other at the end of such measurement time of 10 seconds, thereafter Belt A maintains a substantially constant surface resistivity whereas the surface resistivity of Belt B increases with time. Consequently, the measurements obtained at the 10-second point do not provide an accurate evaluation of the characteristics of the surface layer of the conventional composite belt.

Such inaccurate evaluation of the characteristics of the surface layer of a conventional composite belt produces variations in the quality of the composite belt. Therefore, even though good charge retention of the composite belt having a high-resistance surface layer mounted on a medium-resistance base layer is obtained to prevent an occurrence of toner scattering in transfer, the electrical withstand voltage remains insufficient to prevent the occurrence of the spot-like discharges, and therefore images with white spots are generated.

SUMMARY OF THE INVENTION

Exemplary aspects of the present invention have been made in view of the above-described circumstances.

Exemplary aspects of the present invention provide a multi-layer endless belt member that can effectively prevent an occurrence of irregularity such as toner scattering and white spots on an image.

Other exemplary aspects of the present invention provide a transfer unit that can incorporate the above-described multi-layer endless belt member.

Other exemplary aspects of the present invention provide an image forming apparatus that can incorporate the above-described multi-layer endless belt member Other exemplary aspects of the present invention provide a method of evaluating the above-described multi-layer endless belt member.

In one exemplary embodiment, a multi-layer endless belt member, which is for use in an image forming apparatus and includes a volume resistivity and a surface resistivity, includes a high-resistance surface layer for carrying a toner image thereon. The volume resistivity of the multi-layer endless belt ranges from approximately 8.0 to approximately 11.0 in a common logarithm value (log [Ω·cm]). The multi-layer endless belt member has a resistivity on a first surface serving as an outer surface of the multi-layer endless belt member and a resistivity on a second surface serving as an inner surface of the multi-layer endless belt member. An amount of resistivity change of the first surface of the multi-layer endless belt member is greater than an amount of resistivity change of the second surface of the multi-layer endless belt member, where the amount of resistivity change of the first surface indicates a difference between a surface resistivity value measured after a given voltage is applied for 1 second and a surface resistivity value measured after a given voltage is applied for 100 seconds on the first surface of the multi-layer endless belt member and the amount of resistivity change of the second surface indicates a difference between a surface resistivity value measured after a given voltage is applied for 1 second and a surface resistivity value measured after a given voltage is applied for 100 seconds on the second surface of the multi-layer endless belt member.

The difference between the amount of resistivity change of the first surface and the amount of resistivity change of the second surface may be 0.05 or more in a common logarithm value (log [Ω/square]).

The difference between the amount of resistivity change of the first surface and the amount of resistivity change of the second surface may be 1.0 or less in the common logarithm value (log [Ω/square]).

When the multi-layer endless belt is used as an intermediate transfer belt in the image forming apparatus to form an image, a difference between the amount of resistivity change of the first surface and the amount of resistivity change of the second surface may be within a range which the image is produced without white banding.

A volume dependency of volume resistivity measured at 10V and a volume dependency of volume resistivity measured at 100V may be 1.5 or greater in a common logarithm value (log [Ω·cm]).

A material of the multi-layer endless belt member may be one of a polyimide and a polyamide-imide.

Further, in one exemplary embodiment, a transfer unit includes the above-described multi-layer endless belt configured to serve as an intermediate transfer member to temporarily transfer a toner image formed on an image carrier thereto.

Further, in one exemplary embodiment, an image forming apparatus includes an image carrier configured to carry a latent image on a surface thereof, a developing unit configured to develop the latent image formed on the surface of the image carrier into a toner image, and the above-described transfer unit having the above-described multi-layer endless belt member therein.

The transfer unit may include an external roller and an internal roller. The external roller may have a single layer structure and be configured to contact a recording medium against the first surface of the multi-layer endless belt member. The internal roller may face the external roller via the intermediate transfer belt.

A resistance of the internal roller may be greater than a resistance of the external roller.

The resistance of the internal roller may be greater than the resistance of the external roller by 1.0 or greater in units of a common logarithm value (log [Ω]).

Further, in one exemplary embodiment, a method of evaluating a multi-layer endless belt member with a high-resistance surface layer for use in an image forming apparatus, the multi-layer endless belt member includes obtaining an amount of resistivity change of a first surface serving as an outer surface of the multi-layer endless belt member indicating a difference between a surface resistivity value measured after a given voltage is applied for 1 second and a surface resistivity value measured after a given voltage is applied for 100 seconds on the first surface, obtaining an amount of resistivity change of a second surface serving as an inner surface of the multi-layer endless belt member indicating a difference between a surface resistivity value measured after a given voltage is applied for 1 second and a surface resistivity value measured after a given voltage is applied for 100 seconds on the second surface, calculating a difference between the amount of resistivity change of the first surface and the amount of resistivity change of the second surface, obtaining a volume resistivity of the multi-layer endless belt member, and by using the difference between the amounts of resistivity change of the first and second surfaces and the volume resistivity of the multi-layer endless belt member, determining whether the volume resistivity thereof ranges from 8.0 to 11.0 and whether the amount of resistivity change of the first surface thereof is greater than the amount of resistivity change of the second surface thereof by 0.05 or more in a common logarithm value (log [Ω/square]).

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
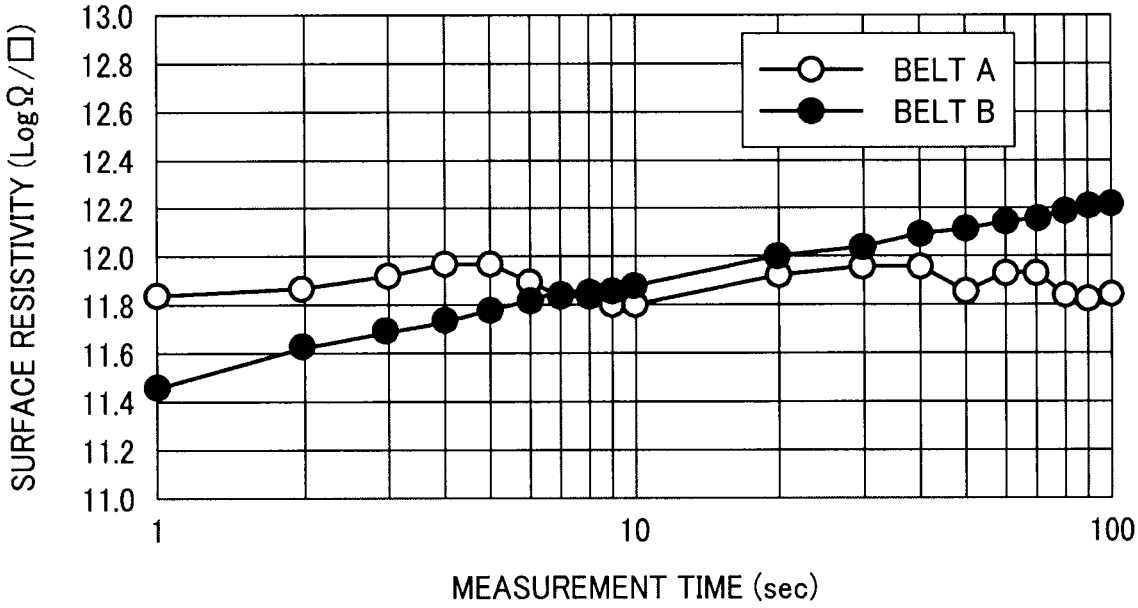
FIG. 1 BACKGROUND ART
FIG. 1 is a graph showing changes of surface resistivity of two composite belts according to an example of a background art.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

First Exemplary Embodiment

Figure 2:
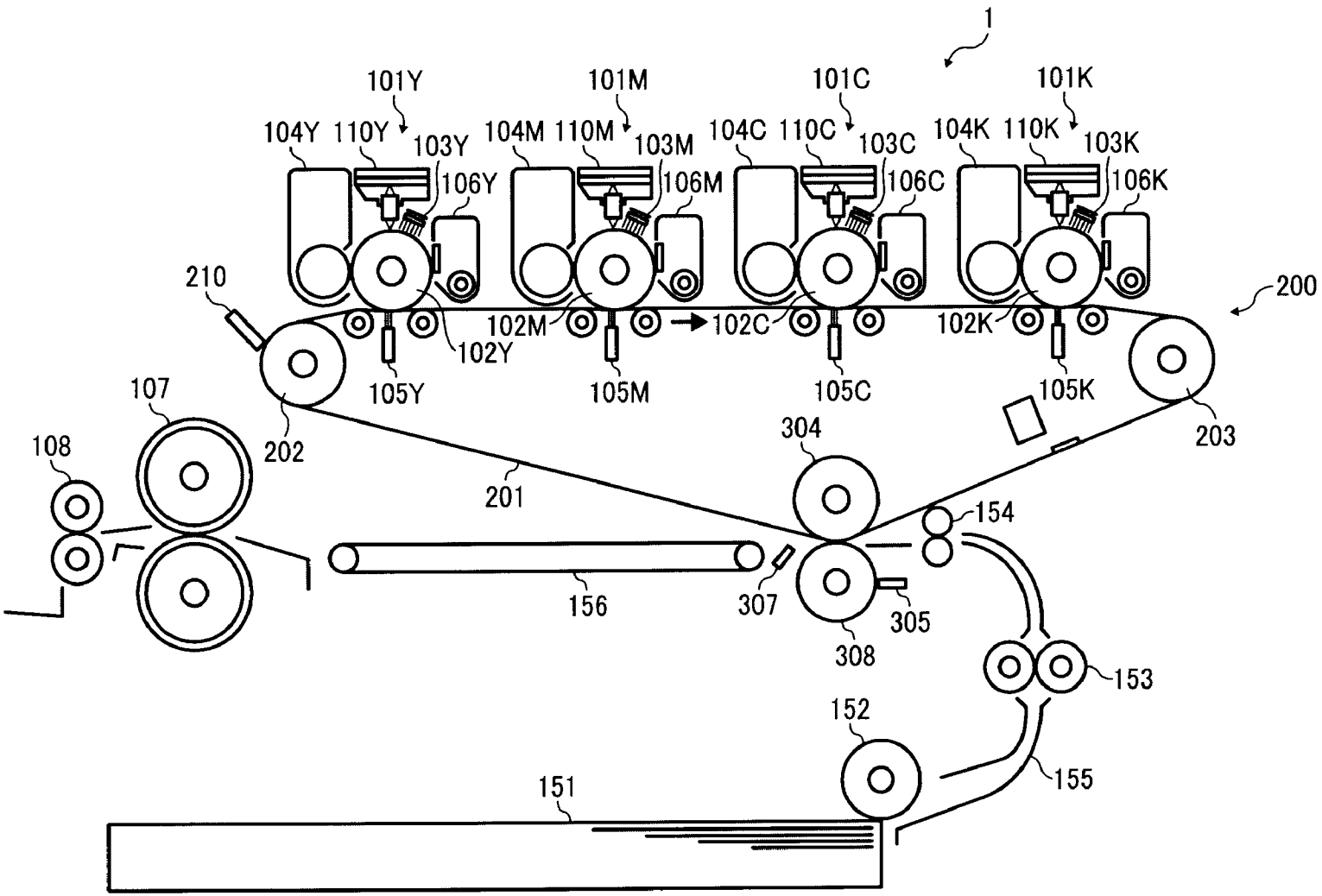
FIG. 2 is a schematic configuration of an image forming apparatus according to an exemplary embodiment of the present invention.

FIG. 2 is a drawing of a schematic configuration of an image forming apparatus 1 according to a first exemplary embodiment of the present invention.

The image forming apparatus 1 of FIG. 2 corresponds to a printer, copier, facsimile machine, etc. and employs a tandem type indirect transfer system. In other words, the image forming apparatus 1 includes multiple image forming units 100Y, 101M, 101C, and 101K that are disposed along an intermediate transfer belt 201 that serves as an intermediate transfer member. The image forming apparatus 1 includes a transfer unit 200 at a center part thereof. The transfer unit 200 includes the intermediate transfer belt 201 in a form of an endless belt member. The intermediate transfer belt 201 is wound around multiple supporting rollers, which are a first supporting roller 202, a second supporting roller 203, and a third supporting roller 304. The intermediate transfer belt 201 is rotationally conveyable in a clockwise direction in FIG. 2.

An intermediate transfer belt cleaning unit 210 is disposed on the left side of the first supporting roller 202 of the multiple supporting rollers in FIG. 2. The intermediate transfer belt cleaning unit 210 removes residual toner remaining on an outer surface or outer circumferential surface of the intermediate transfer belt 201 after image transfer.

The four image forming units 101Y, 101M, 101C, and 101K for colors of yellow (Y), magenta (M), cyan (C), and black (K), respectively, are located above the intermediate transfer belt 201, particularly above a part extended between the first supporting roller 202 and the second supporting roller 203, and are arranged side by side along a conveyance direction of the intermediate transfer belt 201. The image forming units 101Y, 101M, 101C, and 101K constitute a tandem type image forming mechanism. The image forming units 101Y, 101M, 101C, and 101K of the tandem type image forming mechanism have substantially the same configuration, as shown in FIG. 3, for example.

Figure 3:
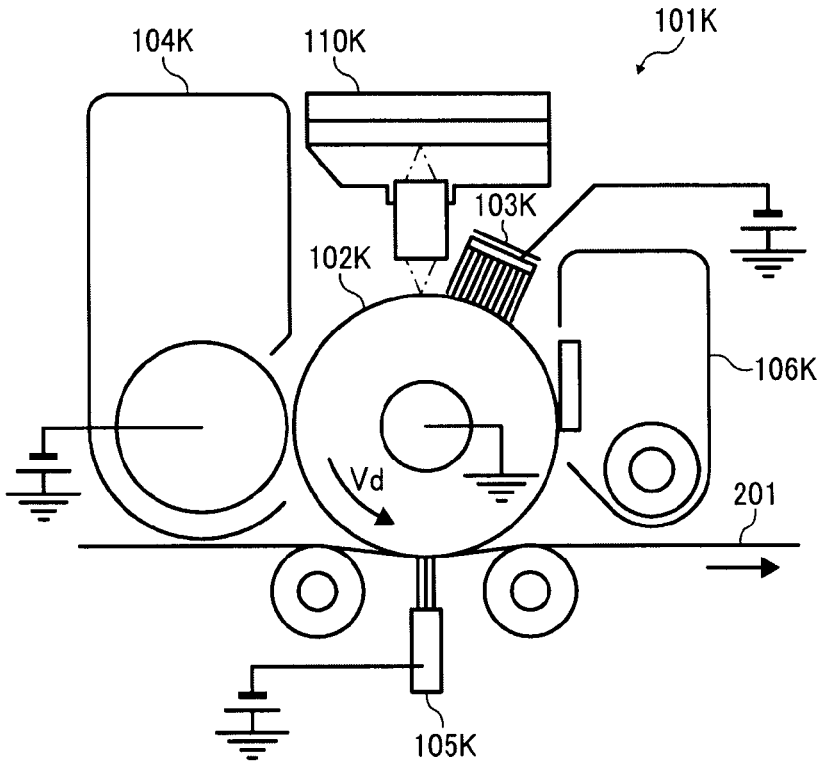
FIG. 3 is a schematic configuration of an image forming unit incorporated in the image forming apparatus of FIG. 2.

FIG. 3 illustrates a schematic configuration of the image forming unit 101K for black (K) as an example. The image forming unit 101K includes a drum-shaped photoconductor 102K, a charging unit 103K, an optical writing unit 110K, and a developing unit 104K. The photoconductor 102K serves as an image carrier for forming and carrying a toner image on a surface thereof. The charging unit 103K, the optical writing unit 110K, and the developing unit 104K are image forming components for forming a toner image on the surface of the photoconductor 102K.

The charging unit 103K uniformly charges the surface of the photoconductor 102K. The charging unit 103K of FIG. 3 employs a charging brush to which direct current voltage is applied. However, the charging unit 103K is not limited to a charging brush but can be a charging roller, and electrifying charger, or the like.

The optical writing unit 110K is an exposing unit of a LED writing system including a light emitting diode (LED) array and a lens array arranged in an axial direction or a main scanning direction of the photoconductor 102K in FIG. 3. The optical writing unit 110K emits the LED according to an image signal to form an electrostatic latent image on the surface of the photoconductor 102K. Other than this optical writing unit 110K, it is also possible to use an optical writing unit of a laser scanning system including a laser beam source, a light deflector such as a rotary polygon mirror, and an image scanning optical system.

The developing unit 104K includes a developing roller that rotates while carrying a developer and agitating/conveying member that agitates the developer and conveys the developer to the developing roller. The developing unit 104K develops an electrostatic latent image formed on the surface of the photoconductor 102K with toner contained in the developer to a visible toner image. As the developer, either one-component developer consisting of only toner or two-component developer consisting of toner and magnetic carriers is used. Note that, since the image forming unit 101K shown in FIG. 3 is an example of an image forming unit for black (K), black toner is used as the toner. That is, in the image forming units 100Y, 101M, and 101C of other colors shown in FIG. 2, toners of yellow (Y), magenta (M), and cyan (C) are used, respectively.

A toner image that is formed on the surface of the photoconductor 102K through operations performed by the charging unit 103K, the optical writing unit 110K, and the developing unit 104K is transferred onto the outer surface of the intermediate transfer belt 201 in a primary transfer part or an area or part for primary transfer. A transfer brush 105K that serves as a primary transfer member is disposed at a position in the primary transfer part opposed to the photoconductor 102K across the intermediate transfer belt 201. A transfer bias is applied to the transfer brush 105K by a DC power supply. Further, a photoconductor cleaning unit 106K, which removes residual toner remaining on the surface of the photoconductor 102K after image transfer, is provided on a downstream side of the primary transfer part in a direction of rotation of the photoconductor 102K.

The image forming unit 101K for black (K) has been described above as an example. The other image forming units 101Y, 101M, and 101C for yellow (Y), magenta (M), and cyan (C) are configured in the same manner. In FIG. 2, the same image forming components are denoted by the same reference numerals. Suffixes "Y", "M", "C", and "K" are attached to the respective members to distinguish the colors.

In the tandem type image forming units described above, in forming a color image, the image forming units 101Y, 101M, 101C, and 101K for yellow (Y), magenta (M), cyan (C), and black (K) form respective single toner images of yellow (Y), magenta (M), cyan (C), and black (K) on the photoconductors 102Y, 102M, 102C, and 102K, respectively. The image forming units 101Y, 101M, 101C, and 101K transfer the single toner images onto the intermediate transfer belt 201 to overlay the single toner images one on top of another to form a composite color image. In forming a black and white image, only the image forming unit 101K for black (K) forms a monochrome image and transfers the monochrome image onto the intermediate transfer belt 201.

By contrast, a secondary transfer part or an area or part for secondary transfer is provided on a side opposed to the tandem type image forming apparatus 1 across the intermediate transfer belt 201. The secondary transfer part includes a secondary transfer roller 308 that serves as an external roller, a cleaning blade 305, and a charge eliminating needle 307. The secondary transfer roller 308 is disposed to contact a third supporting roller 304, which serves as an internal roller, via the intermediate transfer belt 201 with a certain pressure. The secondary transfer roller 308 transfers a toner image on the intermediate transfer belt 201 onto a recording medium such as a paper sheet.

A sheet feeding part that includes a sheet feed cassette 151 and a sheet feed roller 152, a sheet feed path 155 having a sheet feed roller 153, and a pair of registration rollers 154 are provided on an upstream side of the secondary transfer part in a direction of conveyance of the recording medium.

Further, a conveyance unit 156, a fixing unit 107, and a sheet discharging roller 108 are provided on a downstream side of the secondary transfer part. The conveyance unit 156 conveys a recording medium having an image transferred thereon. The fixing unit 107 fixes the transferred image on the recording medium. The sheet discharging roller 108 discharges the recording medium after fixing to a sheet discharging unit.

Next, a detailed description is given of image forming performed by the image forming apparatus 1 having the above-described configuration.

When a start switch of an operation unit, not shown, is pressed, a drive motor, not shown, rotates one of the first supporting roller 202, the second supporting roller 203, and the third supporting roller 304. At the same time, the other two supporting rollers are rotated with the one supporting roller, whereby the intermediate transfer belt 201 is rotated. At the same time, the photoconductors 102Y, 102M, 102C, and 102K serving as image carriers are rotated in the image forming units 101Y, 101M, 101C, and 101K of the respective colors. Single color images of yellow, magenta, cyan, and black are formed on the photoconductors 102Y, 102M, 102C, and 102K, respectively. According to the conveyance of the intermediate transfer belt 201, these single color images are sequentially transferred onto the intermediate transfer belt 201 to be superimposed one on top of another in the primary transfer part. As a result, a composite full-color image is formed on the intermediate transfer belt 201.

Further, when the start switch is pressed, the sheet feed roller 152 is rotated and a sheet-like recording medium such as paper is fed out from the sheet feed cassette 151 and guided to the sheet feed path 155. The recording medium is further conveyed toward the pair of registration rollers 154 and stopped when it contacts the pair of registration rollers 154.

Thereafter, the pair of registration rollers 154 rotates in synchronization with a movement of the composite full-color image held by the intermediate transfer belt 201. The recording medium is conveyed to a position between the intermediate transfer belt 201 and the secondary transfer roller 308 or an external roller 308 of the secondary transfer part. Then, the full-color image is transferred onto the recording medium according to transfer by the secondary transfer roller 308.

The secondary transfer roller 308 is generally either a single layer elastic foam member or a multi-layer elastic member.

The single layer elastic foam member performs a so-called bias cleaning. That is, the single layer elastic foam does not include a cleaning unit and returns toner adhering to the secondary transfer roller 308 to the intermediate transfer belt 201 by applying a non-image forming bias. The bias cleaning is commonly employed for an apparatus for image forming because the cost of a roller itself is less expensive and no separate cleaning mechanism is required. However, for an image forming apparatus in which a sensor reads image control patterns formed on the intermediate transfer belt 201 so as to perform image control according to results of detection from the sensor, the image control patterns requires significant limitations in pattern size, pattern formation timing, cleaning period of time, cleaning operation timing, etc. These limitations have affected on specifications of the above-described image forming apparatus.

Figure 4:
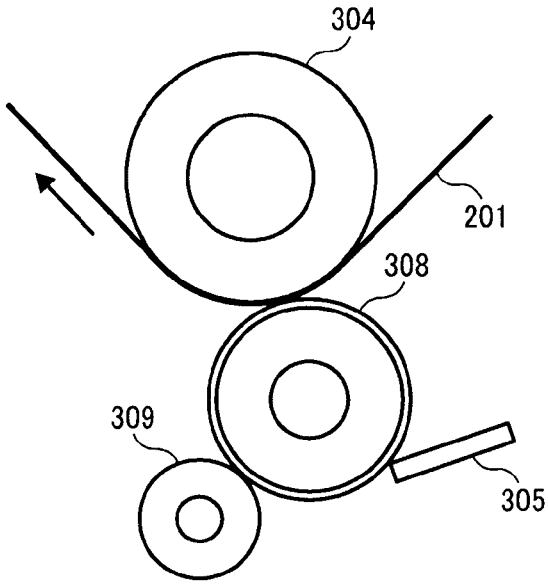
FIG. 4 is a schematic configuration of a secondary transfer part in the image forming apparatus of FIG. 2.

Now, FIG. 4 illustrates the secondary transfer part in the image forming apparatus 1 of FIG. 2.

When the image forming apparatus 1 includes a cleaning unit having the cleaning blade 305 as shown in FIG. 4 and the multi-layer secondary transfer roller 308 mounted on the image forming apparatus 1, the multi-layer secondary transfer roller 308 or the secondary transfer roller 308 having a multi-layer structure can constantly remove toner adhering thereto. Therefore, a back side of a recording medium may not be contaminated, and therefore there is no limitation for forming image control patterns on the intermediate transfer belt 201. Since a cleaning time for cleaning the secondary transfer roller 308 is not necessary, periods of time for a backward rotation and forward rotation, for example, may not be necessary. Since the cost of the roller is expensive and a different cleaning mechanism is required, the multi-layer secondary transfer roller 308 is commonly employed to a high-speed model.

The multi-layer secondary transfer roller 308 includes a cored bar having a cylinder-shaped metal, an elastic layer formed around an outer circumferential surface of the cored bar, and a resin (surface) layer formed on an outer circumferential surface of the elastic layer. Specific example of typical metal that forms the cored bar are, but not limited to, metallic materials such as stainless steel and aluminum. The elastic layer formed on the cored bar generally includes a rubber material to form a rubber layer so as to obtain a secondary transfer nip. It is desirable that the rubber layer has JIS-A hardness of 70 degree or smaller.

Since a blade cleaning is employed for cleaning the multi-layered secondary transfer roller 308, if the elastic layer is excessively soft, a leading edge of the cleaning blade 305 may sink in the elastic layer, which can cause curling of the cleaning blade to cause a contact state thereof to be unstable and a suitable cleaning angle cannot be obtained. Therefore, it is desirable that the elastic layer has JIS-A hardness of 40 degree or greater. Further, as a conductive rubber material, the elastic layer includes an epichlorohydrin rubber and has JIS-A hardness of 50 degree or greater.

The elastic layer can be made of other materials, such as EPDM dispersed with carbon powder, Si rubber, nitrile butadiene rubber (NBR) having an ion conductive function, and urethane rubber.

The surface layer that is necessary to perform the blade cleaning is prepared by adding a fluorine containing resin for providing a lubricating effect and a resistance controlling member for adjusting a resistance to a polyurethane resin, for example, and a layer thickness thereof is formed in a range of from 5 μm to 30 μm.

Further, if the image forming apparatus includes a configuration in which a cleaning blade 305 is provided to a surface of the multi-layer secondary transfer roller 308 to remove toner or if a transfer sheet (recording medium) having a large amount of paper dust or talc is used, the paper dust and/or talc may be stuck between the cleaning blade 305 and the secondary transfer roller 308. This trapping of the paper dust and/or talc therebetween can lead to poor cleaning performance or filming to the surface of the secondary transfer roller 308, which can result in background contamination. Therefore, it is likely to provide a toner remover such as a fur brush 309 before the cleaning blade 305, as shown in FIG. 4.

The method for preparing the intermediate transfer belt 201 is not particularly limited, and any known methods such as dip coating methods, centrifugal molding methods, extrusion molding methods, inflation methods, coating methods, and spraying methods can be used.

The surface layer, which is a thin layer of the composite belt, can be prepared by any suitable known methods. Specific examples of typical methods are, but not limited to, spray coating methods, dip coating methods, and flow coating methods. When using a centrifugal molding method, for example, after molding and drying the upper layer, the base layer is formed, dried, and cured.

Suitable materials for use in preparing a base layer of the intermediate transfer belt 201 include polyimide resins, polyamide-imide resins, polycarbonate resins, polyphenylene sulfide resins, polyurethane resins, polybutylene terephthalate resins, polyvinylidene fluoride resins, polysulfone resins, polyether sulfone resins, polymethyl pentene resins, and combinations thereof. In view of the strength, polyimide resins, and polyamide-imide resins are preferably used. It is preferable to add an electro conductive carbon black to the intermediate transfer belt 201 to control the resistivity thereof.

Next, an example of the centrifugal molding method for preparing the intermediate transfer belt 201 using a polyimide resin will be explained.

Polyimide resins are typically prepared by subjecting an aromatic polycarboxylic anhydride (or a derivative thereof) and an aromatic diamine to a condensation reaction. Because of having a rigid main chain, such polyimide resins are insoluble in solvents and are not melted even when heated. Therefore, at first, a polyamic acid (i.e., a polyamide acid or an aromatic polyimide precursor), which can be dissolved in an organic solvent, is prepared by reacting an anhydride with an aromatic diamine. After the polyamic acid (or the like) is molded by any known methods, the molded polyamic acid is heated or subjected to a chemical treatment to perform dehydration and ring formation (i.e., imidization). Thus, a molded polyimide resin is prepared.

Specific examples of the aromatic polycarboxylic anhydrides include ethylenetetracarboxylic dianhydride, cyclopentanetetracarboxylic dianhydride, pyromellitic anhydride, 3,3'1,4,4'-benzophenonetetracarboxylic dianhydride, 3,3',4,4'-biphenyltetracarboxylic dianhydride, etc., but are not limited thereto. These compounds can be used alone or in combination.

Specific examples of the aromatic diamines include m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, etc., but are not limited thereto. These compounds can be used alone or in combination.

By polymerizing an aromatic polycarboxylic anhydride with a diamine, which are mixed in a molar ratio of about 1:1, in a polar organic solvent, a polyimide precursor (i.e., a polyamic acid) can be prepared. Suitable solvents for use as the polar organic solvent includes any known polar organic solvents, which can dissolved a polyamic acid, and N,N-dimethylformamide and N-methyl-2-pyrrolidone are preferably used.

Although it is easy to synthesize a polyamic acid, various polyimide varnishes in which a polyamic acid is dissolved in an organic solvent are marketed. Specific examples of such varnishes include TORAYNEECE (from Toray Industries Inc.), U-VARNISH (from Ube industries, Ltd.), RIKACOAT (from New Japan Chemical Co., Ltd.), OPTOMER (from Japan Synthetic Rubber Co., Ltd.), SE812 (from Nissan Chemical Industries, Ltd.), CRC8000 (from Sumitomo Bakelite Co., Ltd.), etc.

Specific examples of the resistivity controlling agents for use in the polyimide resins include powders of electroconductive resistivity controlling agents such as carbon black, graphite, metals (e.g., copper, tin, aluminum, and indium), metal oxides (e.g., tin oxide, zinc oxide, titanium oxide, indium oxide, antimony oxide, bismuth oxide, tin oxide doped with antimony, and indium oxide doped with tin), etc.

In addition, ion-conducting resistivity controlling agents can also be used. Specific examples thereof include tetraalkyl ammonium salts, trialkylbenzyl ammonium salts, alkylsulfonic acid salts, alkylbenzenesulfonic acid salts, alkylsulfates, esters of glycerin and a fatty acid, esters of sorbitan and a fatty acid, polyoxyethylenealkylamine, esters of polyoxyethylenealiphatic alcohols, alkylbetaine, lithium perchlorate, etc., but are not limited thereto.

Among these resistivity controlling agents, carbon black is preferably used for polyimide resins.

The thus prepared polyamic acid is heated at a temperature of from 200 degrees Celsius to 350 degrees Celsius to be converted to a polyimide resin.

Next, the melt molding method for preparing the intermediate transfer belt 201 will be explained.

When continuous melt extrusion molding methods are used for preparing seamless belts, thermoplastic resins are preferably used. Specific examples of such thermoplastic resins include polyethylene, polypropylene, polystyrene, polybutylene terephthalate (PBT), polyethylene terephthalate (PET), polycarbonate (PC), ethylene-tetrafluoroethylene copolymers (ETFE), polyvinylidene fluoride (PVdF), etc.

Melt molding methods are broadly classified into continuous melt extrusion molding methods, injection molding methods, blow molding methods, inflation molding methods, etc. Among these methods, continuous melt extrusion molding methods are preferably used for preparing a seamless belt.

Carbon black is typically used as an electroconductive agent for the intermediate transfer belt 201. The dispersion state of a carbon black in a belt formed by a melt extrusion method is typically inferior to that in a belt formed by a centrifugal method using a dispersion in which a carbon black is dispersed in a resin solution. Therefore, the variation of resistivity of a belt formed by a melt extrusion method is typically larger than that of a belt formed by a centrifugal method.

A material suitable for the surface layer of the intermediate transfer belt 201 is not limited to a specific material but is demanded to be a material to reduce an adhesion force of toner to the outer circumference of the intermediate transfer belt 201 and to increase secondary transferability. Suitable examples of materials of the surface layer of the intermediate transfer belt 201 are, but not limited to, resin materials such as polyurethane, polyester, polyamide, etc. A coat layer including these resin materials can be obtained as a resin coat film by a curing agent such as isocyanato, melamine, silane coupling agent, and carbodiimide. Further, by filling a mold releasing filler, such as polytetrafluoroethylene (PTFE), silica, molybdenum disulfide, and carbon black, the coat layer can increase mold releasing performance of the surface thereof to improve the cleaning performance and prevent accumulation of toner and discharge product material. Further, the coat layer can include conductive fillers (conductive agents), such as conductive carbon black, tin oxide, zinc oxide to control the resistance. Further, the coat layer can include surface active agents, such as fluorine-containing surface active agent, silicone-containing surface active agent, nonion-containing surface active agent to uniformly mixing and dispersing these fillers.

One or more polyurethane resin, polyester resin, epoxy resins, etc. can be used. Further, lubrication must be high by reducing the surface energy. Therefore, one or more powders or particles of fluorine resin, fluorine compound, carbon fluoride, titanium dioxide, and silicon carbide can be dispersed in the layer; or the same kinds of the above material whose particle diameter is different can be dispersed in the layer. In addition, similar to fluorine containing rubber materials, the surface energy can be reduced by forming a fluorine-rich layer on the outer circumference of the intermediate transfer belt 308 by applying heat treatment. Carbon black can be used for resistance controlling.

[Composite Belt]

Figure 5A:
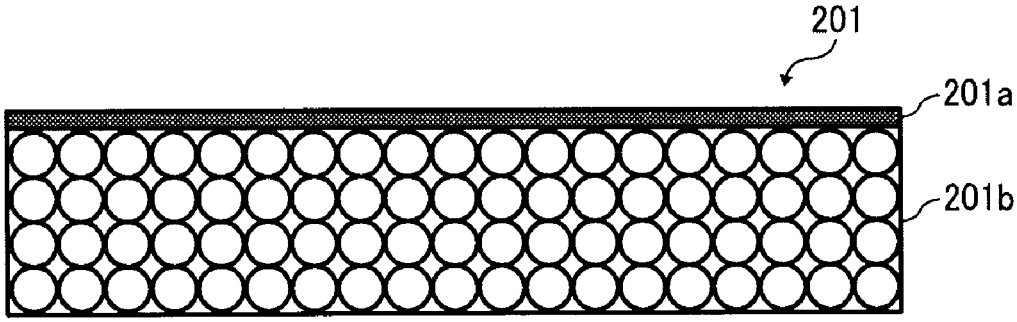
FIG. 5A is a schematic view of a composite belt having a lamination structure.
Figure 5B:
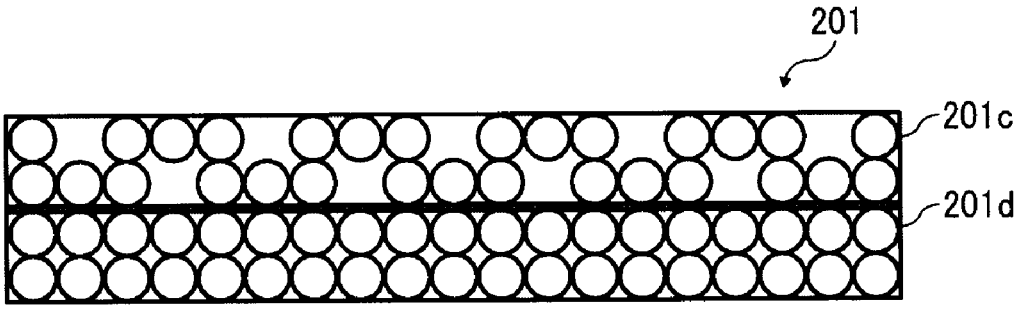
FIG. 5B is a schematic view of a composite belt having a single layer structure.
Figure 5C:
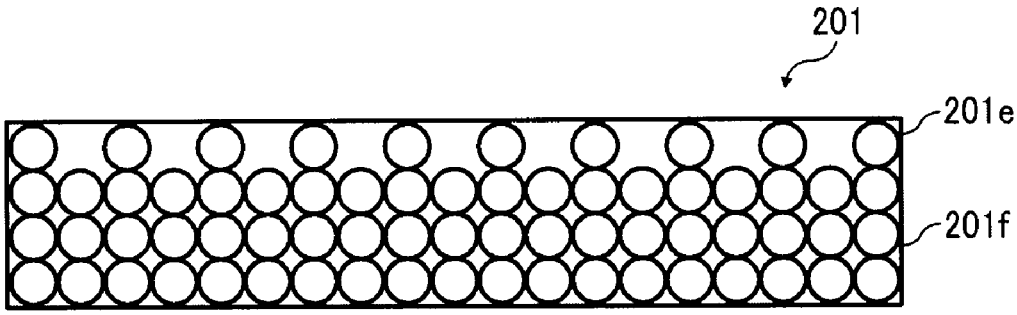
FIG. 5C is a schematic view of a composite belt having a single layer structure.

Referring to FIGS. 5A, 5B, and 5C, cross-sectional views of schematic configurations of composite belts having different resistances in a direction of thickness. Each composite belt corresponds to the intermediate transfer belt 201.

In FIGS. 5A, 5B, and 5C, each circle (○) represents a conductive agent (carbon black) to indicate that, where the more the conductive agents are, the smaller the resistance of the composite belt or the intermediate transfer belt 201 is. That is, the composite belts or the intermediate transfer belts 201 of FIGS. 5A, 5B, and 5C have respective layers having resistance higher than respective base layers.

The conductive agents, not illustrated, are added to a surface layer 201 over a base layer 201*b* of the intermediate transfer belt 201 having a lamination structure of FIG. 5A.

A heavy line shown in the intermediate transfer belt 201 having a two-layer structure of FIG. 5B indicates a boundary between an upper layer 201*c* and a base layer 201*d* having different resistances.

A surface side of the intermediate transfer belt 201 having a single-layer structure of FIG. 5C includes a smaller number of conductive agents to form a high-resistance layer portion 201*e* of a base layer portion 201*f*. Even though the layer of the intermediate transfer belt 201 of FIG. 5C is not separated, it has different resistance in the layer. That is, in the intermediate transfer belt 201 of FIG. 5C, the resistance of one surface is greater than the resistance of the other surface. Therefore, the intermediate transfer belt 201 is regarded as a composite belt.

[Example of Manufacturing Intermediate Transfer Belt]

Polymerization of 3,3',4,4'-biphenyl tetracarboxylic acid dianhydride as the aromatic polyhydric carboxylic anhydride, p-phenylenediamine as the aromatic diamine, and N-methyl-2-pyrrolidone as the organic polar solvent was performed to obtain a polyamic acid solution. Acetylene black was added to the polyamic acid solution, to the amount of 17% to the solid content density thereof. The mixture is agitated with Aquamizer manufactured by HOSOKAWA MICRON CORPORATION. Thus, polyamic acid having 18% of solid content as precursor of polyimide resin was prepared.

The polyamic acid obtained as above was molded into a ring or loop through a centrifugal molding method while a metal cylindrical mold having a diameter of 250 mm was rotated at a speed of 100 rpm, and polyamic acid having a solid content of 19% was uniformly applied to an inner surface of the cylindrical mold by a dispenser. Next, the cylindrical mold was rotated at a speed of 1000 rpm for 5 minutes to level the polyamic acid. Then, the rotation speed was reduced to 300 rpm, and the cylindrical mold was gradually heated to 130 degrees Celsius. The polyamic acid was dried for 40 minutes and was solidified. After the solidification, the cylindrical mold was stopped to rotate and heated to 350 degrees Celsius, to cause imide ring-closing. Thus, imidization was completed and polyimide coating was obtained.

Next, the cylindrical mold was cooled to room temperature and the polyimide coating was removed therefrom. Both edges of the polyamic coating were cut off so that the polyamic coating had a width of 250 mm. From the above, a seamless intermediate transfer belt 201 having a layer thickness of 80 μm was produced. The resistance of the intermediate transfer belt 201 was adjusted by a conductive additive amount (carbon black).

Next, the seamless intermediate transfer belt 201 that serves as a base layer having a layer thickness of 80 μm covered the cylindrical mold having a diameter of 248 mm. Both edges in a longitudinal direction of the cylindrical mold are sealed up with tape.

Polyurethane pre-polymer (100 parts by weight), curing agent; isocyanate (3 parts by weight), PTFE fine powder (50 parts by weight), dispersing agent (4 parts by weight), and MEK (500 parts by weight) were uniformly dispersed for a surface layer. The cylindrical mold with polyimide resin formed thereon was dipped, pulled out at 30 mm/sec, and dried naturally. The above process was repeated to form a surface layer of urethane polymer having a thickness of 5 μm where the PTFE was uniformly dispersed. After dried in room temperature, the cylindrical mold was cross-linked at 130 degrees C for 2 hours to obtain the intermediate transfer belt 201 having a two-layer structure with a resin layer having a thickness of 80 μm and a surface layer having a thickness of 5 μm.

A layer thickness of the surface layer was adjusted with the number of repeats and solid density. Further, a resistance of the surface layer was changed by an amount of addition of conductive agents, for example. Further, the two-layer belt was formed by the centrifugal molding method.

The inventor of the present invention performed the measurement method of surface resistivity of the intermediate transfer belt 201 according to the first exemplary embodiment with a high-resistance measuring instrument, HIRESTA-UP from MITSUBISHI CHEMICAL CORPORATION. The measurement conditions are as follows;

Resistance measuring instrument: HIRESTA-UP (manufactured by MITSUBISHI CHEMICAL CORPORATION);
Probe: URS probe;
Object Supporting Member: REGI TABLE, insulated;
Measurement Voltage: 500V;
Measurement Time: 10 second point; and
Pressure Force: 2 kgf.

In the first exemplary embodiment, volume resistivity and surface resistivity are described in common logarithm values.

Volume Resistivity: log (Ω·cm)
Surface Resistivity: log (Ω/square)

Example 1

In Example 1, an intermediate transfer belt 201 having a single layer structure was used to examine attenuation of potential of the intermediate transfer belt 201. The single layer of a polyimide resin having a thickness of 80 μm was formed by adjusting a conductive additive amount of carbon black by using the centrifugal molding method and changing the resistance of the intermediate transfer belt 201.

Figure 6:
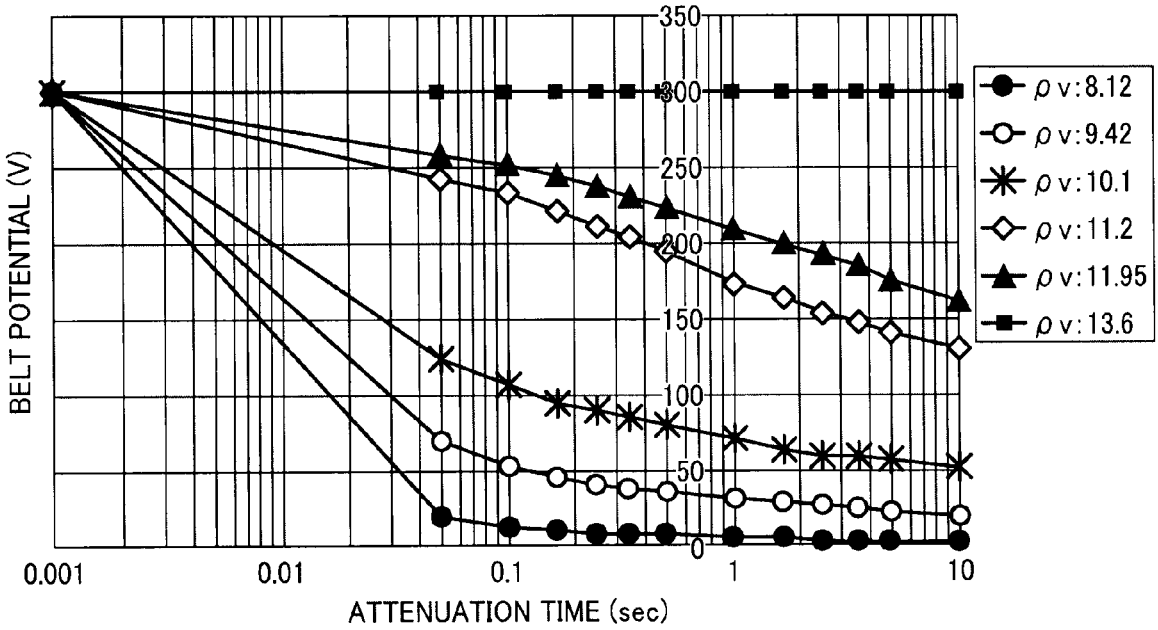
FIG. 6 is a graph showing potential attenuation of intermediate transfer belts having different volume resistivities.

FIG. 6 is a graph showing potential attenuation of the intermediate transfer belts 201 having different resistivities. The volume resistivity was measured with a resistance measuring instrument, HIRESTA-UP (manufactured by Mitsubishi Chemical Corporation). The measurement condition are as follows.

[Volume Resistivity Measurement Method/Condition]

Resistance measuring instrument: HIRESTA-UP (manufactured by Mitsubishi Chemical Corp.);
Probe: URS probe;
Object Supporting Member: REGI TABLE, with conductive rubber having a thickness of 1 mm;
Measurement Voltage: 100V;
Measurement Time: 10 second point; and
Pressure Force: 2 kgf.

Figure 7:
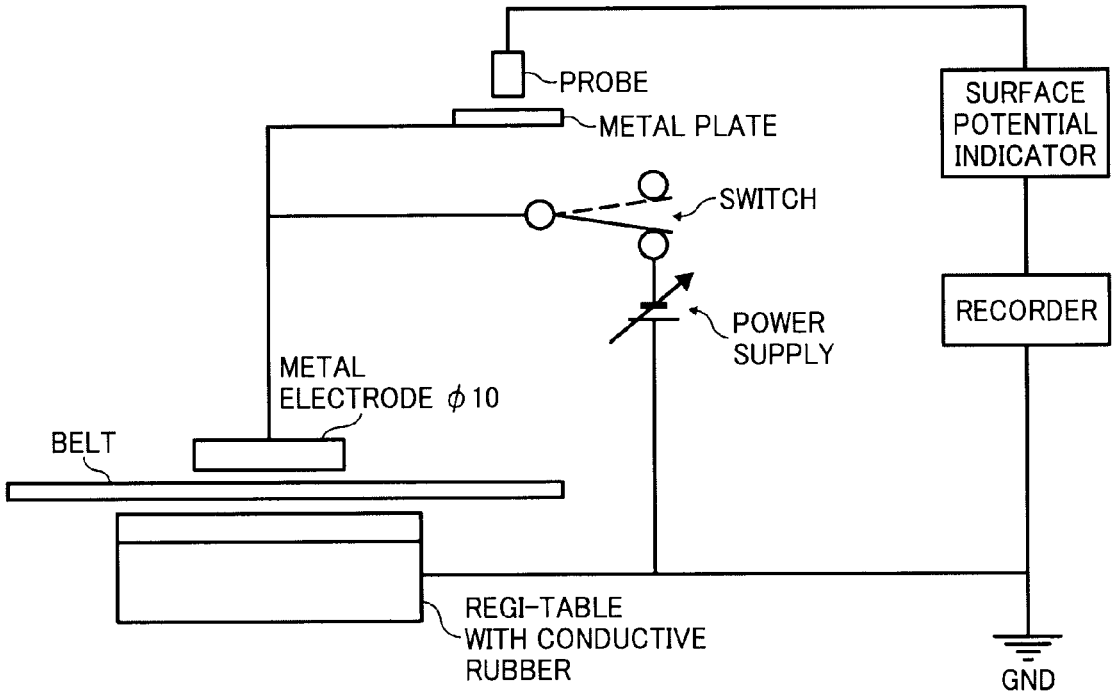
FIG. 7 illustrates a schematic configuration of a measurement unit of belt potential attenuation.

The potential attenuations shown in FIG. 6 indicate attenuation characteristics obtained by using a measuring unit of attenuation of belt electric potential as shown in FIG. 7, by applying a voltage of 300V for 10 seconds. The measurement of the potential attenuation was conducted according to the following instructions.

[Measurement of Belt Potential Attenuation]

A belt potential attenuation measurement was performed such that, as shown in FIG. 7, a belt was placed on an opposing electrode formed of a metal plate, "REGI-TABLE", on which a conductive rubber with a thickness of 1 mm thick was mounted. Then, a metal electrode with a diameter ϕ of 10 mm is placed over the belt, and a load of 2 kg was applied thereto. And, a high-voltage power supply (Model 610C, manufactured by TREK) applied a constant voltage (100V) for 10 seconds between the opposing electrode, "REGI-TABLE", and the metal electrode, and subsequently turned off a switch in FIG. 7 while the voltage is applied. Thus, the attenuation characteristics of the intermediate transfer belt 201 was measured.

Further, the metal electrode was connected to a metal plate for measurement of the potential so that a voltage according to the belt potential can be induced to the metal plate for measurement of the potential. The potential of the metal plate was then measured by a surface electrometer (Model 344, manufactured by TREK JAPAN CO., LTD.) so that the attenuation characteristics were obtained. A distance between the metal plate for potential measurement and a probe of the surface electrometer was set to approximately 1 mm.

A recorder (Linearcoder WR3101, manufactured by GRAPHTEC CORPORATION) was used to output a surface potential so that a speed was measured according to an attenuation curve. Further, the output values of the surface potential can be input to a personal computer or PC to measure the attenuation characteristics, which is more preferable. In an exemplary embodiment, the output values of the surface potential of the intermediate transfer belt 201 were input to the PC to measure the potential attenuation.

The attenuation of belt potential shown in the graph of FIG. 6 indicates the attenuation time in a logarithmic display. A measurement value at the 0 second point cannot be set, and therefore, as a matter of convenience, a measurement value at the 0.001 second point is set as an initial belt potential.

Figure 8:
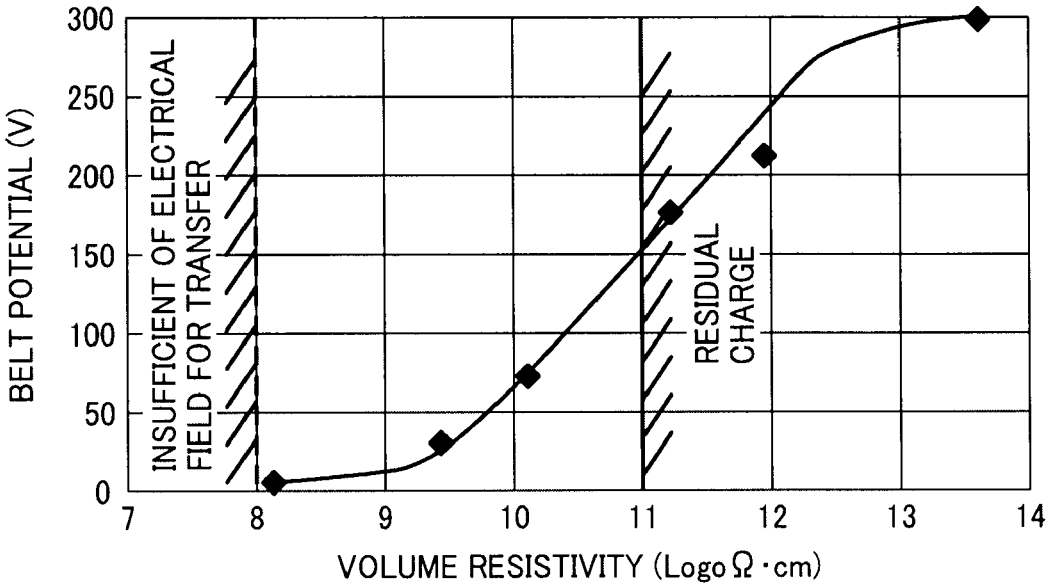
FIG. 8 is a graph showing a relation of potential and volume resistivity of a belt measured at an attenuation time of 1 second.

FIG. 8 is a graph showing a relation of potential and volume resistivity of the intermediate transfer belt 201 measured at an attenuation time point of 1 second. As can be seen from the graph of FIG. 8, when the volume resistivity of the intermediate transfer belt 201 is 11.0, the potential in the 1-second attenuation time point reduces to 150V, which is half a value of the applied voltage, 300V. When the volume resistivity value is under 11.0, any problems such as an occurrence of afterimages due to residual charge residual charge were not seen. Further, when the volume resistivity is less than 8.0, the resistance of a paper sheet, for example, can increase. If the application voltage increases, the electrical durability of the intermediate transfer belt 201 can become insufficient. If a sufficient electric field for transfer cannot be obtained, images may be produced with poor transferability.

Further, in the first exemplary embodiment, intermediate transfer belts having a single layer structure with different volume resistivities were used to evaluate the potential attenuation. However, substantially same attenuation characteristics can be obtained with a multi-layer or composite belt.

Table 1 shows differences between amounts of resistivity changes of outer and inner surfaces of an intermediate transfer belt 201 including a high-resistant surface layer and a medium-resistant base layer, where resistance and thickness of the surface layer material were varied. The thickness of the surface layer was measured by photographing a cross sectional view thereof by an electronic microscope. Further, as shown in Table 1, the intermediate transfer belt 201 having a single layer structure includes a thickness of a polyimide resin: 80 μm, a value of surface resistivity: 11.0, and a value of volume resistivity: 9.5.

TABLE 1

| | Resistivity of Surface Layer Material | Thickness of Surface Layer (μm) | Volume Resistivity (ρv) | Δρs (Difference between Outer and Inner Surface Resistivity) |
|---|---|---|---|---|
| Example 1 | 14 or above | 2.4 | 10.6 | 1.4 |
| | 12.8 | 1.8 | 9.7 | 0.31 |
| | 12.8 | 4.5 | 9.8 | 0.96 |
| | 12.8 | 6.3 | 10.3 | 1.2 |
| | 11.9 | 1.8 | 9.5 | 0.03 |
| | 11.9 | 4.6 | 9.6 | 0.17 |
| | 11.9 | 6.2 | 9.6 | 0.18 |
| | Nil (Single) | 0 | 9.5 | 0 |

Resistance of the surface layer material was controlled according to volume resistance. A metal planar plate having a thickness of 2 mm was coated by a surface layer material by blade coating method, dried in room temperature, and cross-linked at 130 degrees Celsius for 2 hours to obtain an intermediate transfer belt having a thickness of from 5 μm to 10 μm. The thickness of the intermediate transfer belt was measured by using a micrometer. The volume resistance thereof was measured by using HIRESTAR-UP (manufactured by MITSUBISHI CHEMICAL CORPORATION) under the conditions described below. Further, a measurement voltage had a low withstand voltage due to thin layer and changed according to resistance.

[Measurement Condition of Volume Resistance of Surface Layer Material]

Resistance measuring instrument: HIRESTA-UP (manufactured by Mitsubishi Chemical Corp.);

Probe: URS probe;

Measurement Voltage: 10V;

Measurement Time: 10 second point; and

Pressure Force: 2 kgf.

Next, a description is given of the differences between amounts of resistivity changes of outer and inner surfaces of the intermediate transfer belt 201.

Figure 9:
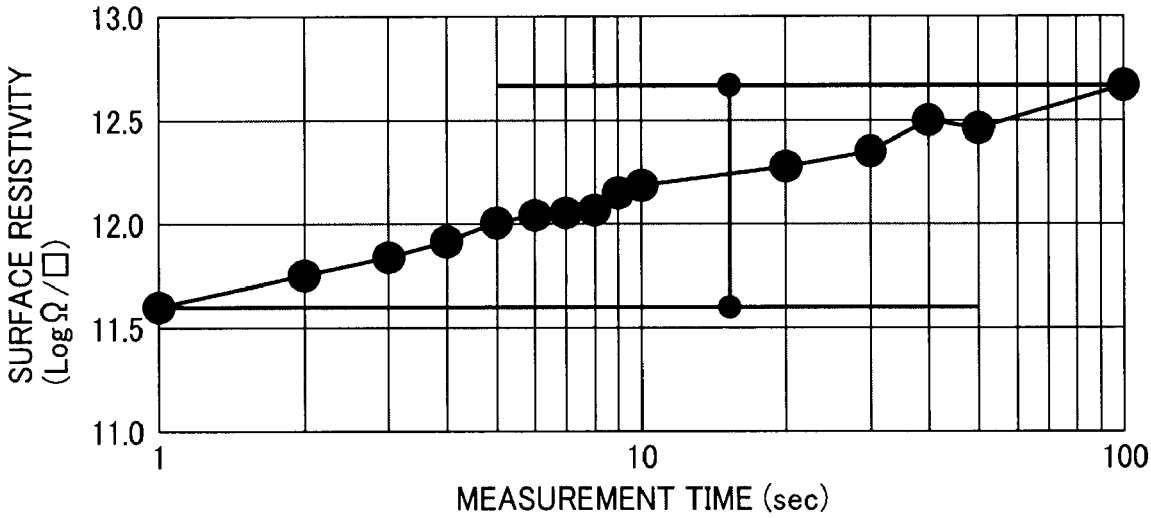
FIG. 9 is a graph showing an amount of surface resistivity change of a belt.

FIG. 9 is a graph showing differences between amounts of surface resistivity changes of the intermediate transfer belt 201. Whereas a Y axis indicates a measurement time of the surface resistivity and an X axis indicates the surface resistivity in a common logarithm value. The amounts of resistivity changes of the surfaces thereof is obtained by subtracting a value of the surface resistivity measured at the 1 second point from a value of the surface resistivity measured at the 100 second point. When a value of the surface resistivity higher than the value measured at the 100 second point was measured during the measurement time between the 1 second point and the 100 second point, the higher value was replaced from the value of the surface resistivity measured at the 100 second point.

Figure 10:
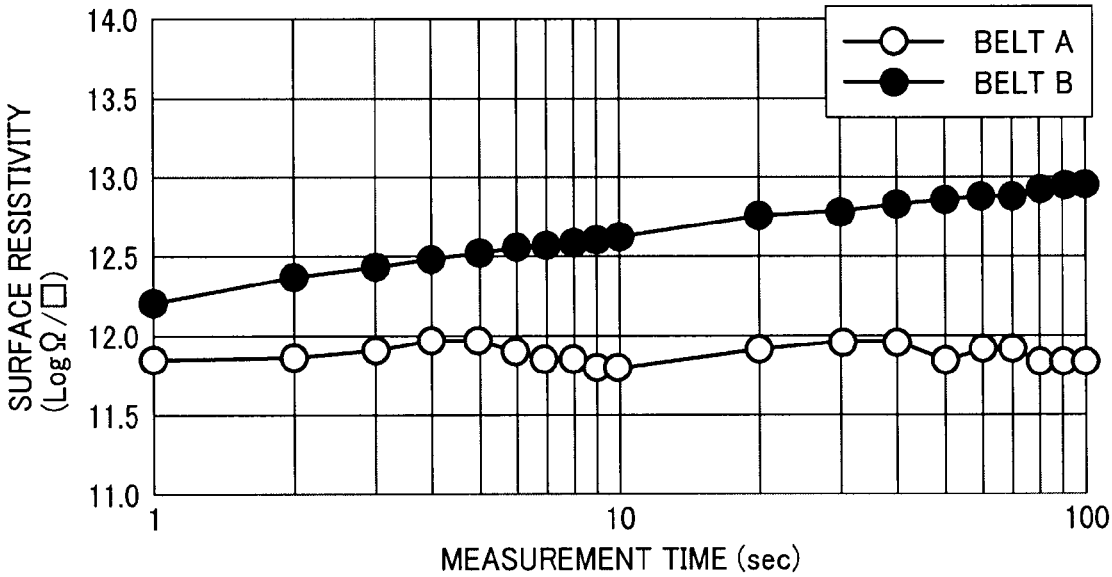
FIG. 10 is a graph showing differences between amounts of surface resistivity changes of two belts.

FIG. 10 is a graph showing differences between amounts of surface resistivity changes of two belts, Belt A and Belt B.

Figure 11:
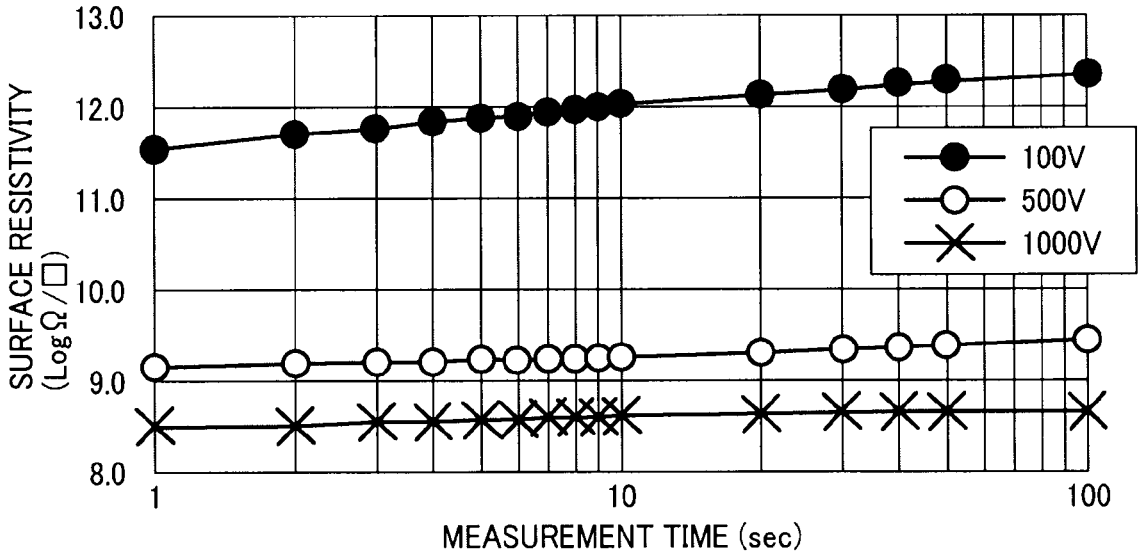
FIG. 11 is a graph showing a relation between different measurement voltages and changes of the surface resistivity.

FIG. 11 is a graph showing a relation between different measurement voltages and changes of the surface resistivity.

Figure 12:
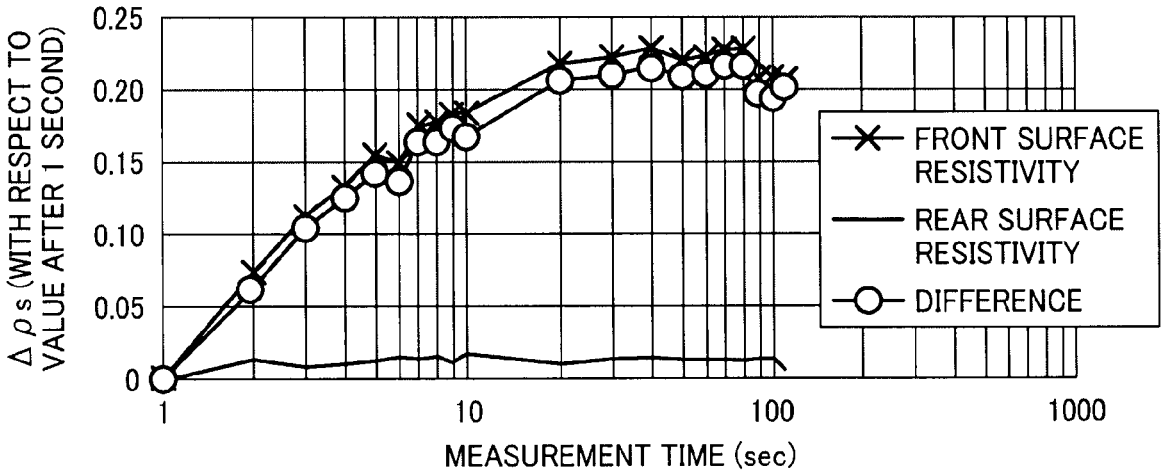
FIG. 12 is a graph showing differences between amounts of resistivity changes of outer and inner surfaces.

FIG. 12 is a graph showing differences between amounts of resistivity changes of the outer and inner surfaces of the intermediate transfer belt 201. That is, the respective amounts of resistivity changes of the outer and inner surfaces thereof when measured by applying a given voltage for one second are indicated. According to the graph of FIG. 12, the amounts of resistivity changes of the outer and inner surfaces thereof are determined as values obtained measuring for 70 seconds and 80 seconds, respectively.

Figure 13:
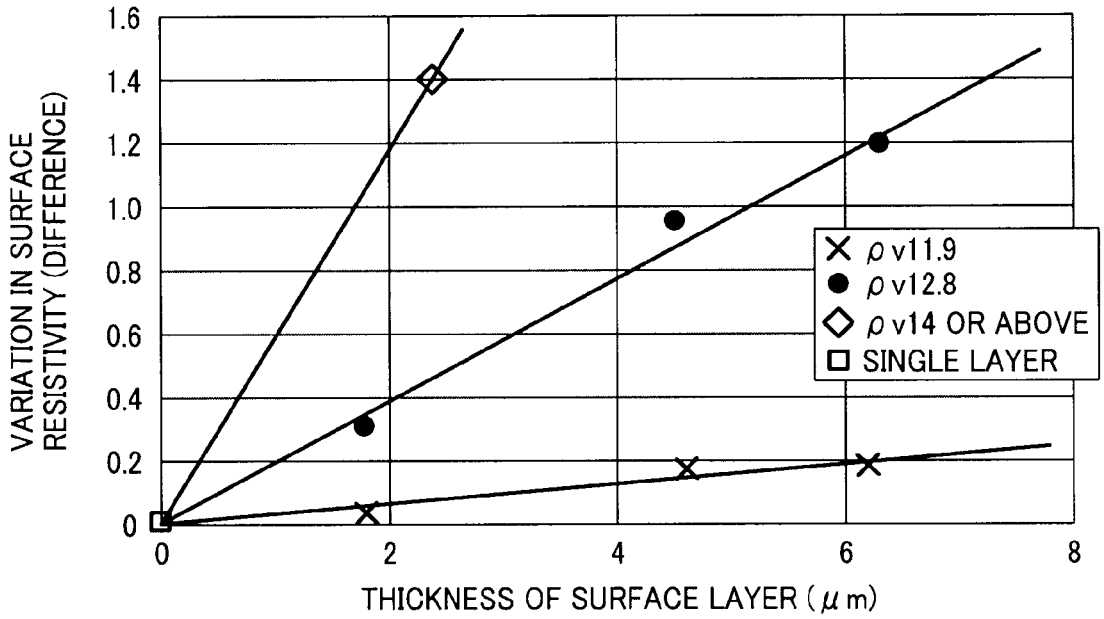
FIG. 13 is a graph showing differences between amounts of resistivity changes of the outer and inner surfaces under separate conditions.

FIG. 13 is a graph showing differences between amounts of resistivity changes of the outer and inner surfaces of the intermediate transfer belt 201 under each condition shown in Table 1.

The intermediate transfer belt 201 having a single layer including polyimide resin was extremely stable in resistance, and the amounts of resistivity changes of the outer and inner surfaces were substantially same.

By contrast, the intermediate transfer belt 201 having a multi-layer or composite structure including a base layer and a surface layer had a correlation between the surface layer thickness and the differences between amounts of resistivity changes of the outer and inner surfaces. The inventor found that, even when there were variations in the surface material resistance and the surface layer thickness, the characteristics of the surface layer were measured accurately. Further, while a volume resistance may vary according to the resistance of the surface layer material and the surface layer thickness, it is difficult to accurately determine whether the variations depend on the resistance of material and the layer thickness of the surface layer or the base layer. Therefore, appropriate surface layer characteristics cannot be obtained.

Example 2

Figure 14:
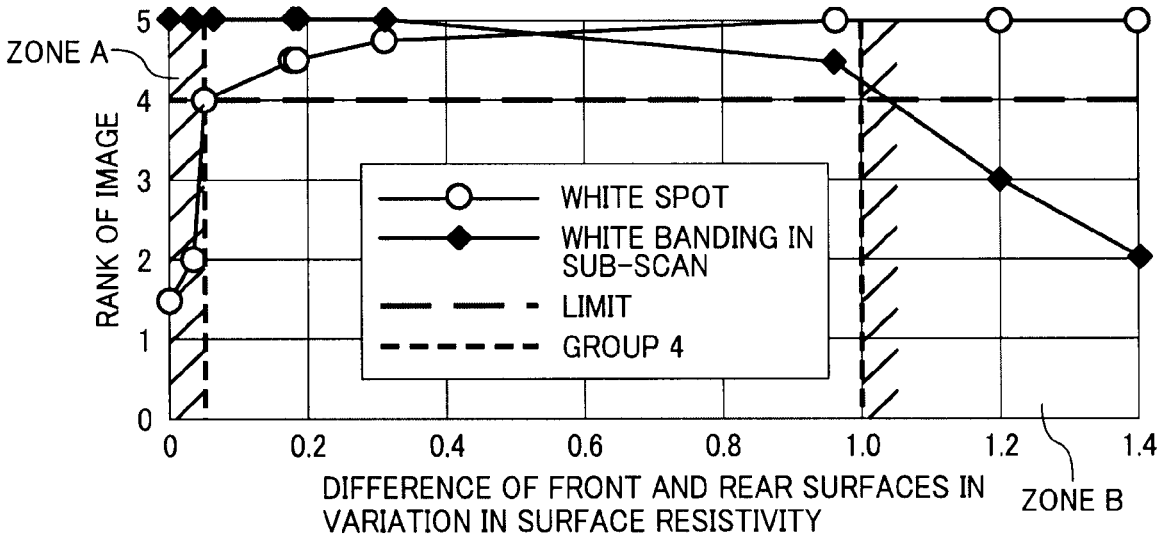
FIG. 14 is a graph showing differences between amounts of resistivity changes of the outer and inner surfaces and image evaluation results.

The differences between amounts of resistivity changes of the outer and inner surfaces of the intermediate transfer belt 201 and evaluation results of images are shown in Table 2 and a graph in FIG. 14. Reference images for evaluation of white spots and horizontal white banding were specified in advance, and the evaluation was conducted to rank the results based on the reference images. Rank 5 represents a highest rank indicating good image performance, and as the level of the rank descends, the image quality degrades. Rank 4 is set to be a threshold or border of acceptance.

TABLE 2

| | Resistivity of Surface Layer Material | Thickness of Surface Layer (μm) | Volume Resistivity (ρv) | Δ (Outer and Inner Surface Resistivity (ρs) | White Spots | Lateral White Banding |
|---|---|---|---|---|---|---|
| Ex. 2 | Nil (Single Layer) | 0 | 9.5 | 0 | 1.5 | 5 |
| | 11.9 | 1.8 | 9.5 | 0.03 | 2 | 5 |
| | 11.9 | 2.2 | 9.5 | 0.06 | 4 | 5 |
| | 11.9 | 4.6 | 9.6 | 0.17 | 4.5 | 5 |
| | 11.9 | 6.2 | 9.6 | 0.18 | 4.5 | 5 |
| | 12.8 | 1.8 | 9.7 | 0.31 | 4.75 | 5 |
| | 12.8 | 4.5 | 9.8 | 0.96 | 5 | 4.5 |
| | 12.8 | 6.3 | 10.3 | 1.2 | 5 | 3 |
| | 14 or above | 2.4 | 10.6 | 1.4 | 5 | 2 |

Further, the image evaluation was conducted with the image forming apparatus 1 of FIG. 2, where the transfer unit 200 provided therein was attached to each of the intermediate transfer belts 201 according to the examples and comparative examples shown in Table 2.

Horizontal white bandings were evaluated with black-and-white halftone images after copying 100 white paper sheets under an environmental condition at a temperature of 10 degrees Celsius and at a relative humidity of 15% RH, and then leaving the image forming apparatus 1 for 8 hours while the photoconductor 102 and the intermediate transfer belt 201 were held in contact with each other.

As can be seen from Table 2 and FIG. 14, if the difference between the amounts of resistivity changes of the outer and inner surfaces Δ ρs was smaller than 0.05, an unacceptable amount of white spots was generated (zone A). If the difference between the amounts of resistivity changes of the outer and inner surfaces Δ ρs was greater than 1.0, an unacceptable horizontal white bandings was generated (zone B). Therefore, the difference between the amounts of resistivity changes of the outer and inner surfaces Δ ρs of the intermediate transfer belt 201 is preferably set within a range of from 0.05 to 1.0. By so doing, even when the resistances of the surface material and the surface layer thicknesses have variations, occurrences of white spots and horizontal white bandings can be reduced. Further, since the surface layer includes a high-resistance material, the charge retention can be higher, thereby reducing the occurrence of toner scattering.

As described above, when the difference between the amounts of resistivity changes of the outer and inner surfaces Δ ρs is greater than 1.0, horizontal white bandings may occur from fatigue of the photoconductor 102 by contacting with the intermediate transfer belt 201 while residual charge remains on the entire belt surface.

Residual charge can cause further image irregularities, such as afterimage. For example, after a toner image is formed on the intermediate transfer belt 201, a secondary transfer voltage is applied to uniformly charge the toner image including a different portion of the intermediate transfer belt 201 that corresponds to a background portion of the toner image, where no toner image is formed. Whereby, an electric potential distribution of the surface of the intermediate transfer belt 201 after secondary transfer may be uneven corresponding to the toner image. That is, a portion where the toner image is formed has low potential and the background portion of the intermediate transfer belt 201 where the toner image is not formed has high potential, which can cause the electric potential on the toner image held on the intermediate transfer belt 201 to be uneven. Such uneven electric potential can cause uneven electric field for transfer, resulting in a production of afterimage.

Therefore, by setting the difference between the amounts of resistivity changes of the outer and inner surfaces Δ ρs to a value equal to or smaller than 1.0, an unacceptable amount of horizontal white bandings can be reduced and, at the same time, an occurrence of afterimage can be prevented.

Further, according to the description above, in the first exemplary embodiment, the intermediate transfer belt 201 having a multi-layer structure including a high-resistance surface layer may be evaluated to determine whether the volume resistivity ranges from 8.0 to 11.0 in a common logarithm value (log [Ω·cm]) and whether the difference between the amounts of resistivity changes of the outer and inner surfaces Δ ρs range from 0.05 to 1.0. By so doing, occurrences of toner scattering, white spots, and lateral or horizontal white bandings can be prevented, thereby obtaining the intermediate transfer belt 201 that can prevent occurrence of toner scattering, white spots, and horizontal white banding.

Second Exemplary Embodiment

Next, examples and comparative examples according to a second exemplary embodiment are described.

Since the secondary transfer is affected by significant resistance vibrations of transfer sheet or paper, a constant current control is conducted to the electric field of transfer. That is, when resistances of a paper, a roller, etc. increase, an applied voltage is controlled to increase.

In the second exemplary embodiment, when negatively charged toner on the intermediate transfer belt 201 is transferred onto a transfer sheet, an electric field for secondary transfer is generated in the secondary transfer area. The electric field of secondary transfer may be in a direction where a positive polarity is applied to a cored bar of an external roller or the secondary transfer roller 308 and a negative polarity is applied to a cored bar of an internal roller or the third supporting roller 304. By electrically conducting the internal and external rollers, an increase amount of resistance of the third supporting roller 304 can become smaller than that of the secondary transfer roller 308. A combined resistance of the third supporting roller 304 and the secondary transfer roller 308 contributes significantly to a secondary transfer voltage. Therefore, when an increase in resistance of the roller having a higher resistivity is reduced, an increase in the secondary transfer voltage can also be reduced, which can achieve a higher or greater effect to prevent occurrences of irregularities such as electrical discharges in the secondary transfer part.

Therefore, it is important to increase the resistance of the third supporting roller 304 to the cored bar of which a voltage having a negative polarity is applied and reduce the resistance of the secondary transfer roller 308 to which a voltage having a positive polarity is applied. It is also important that, even when the resistance of the secondary transfer roller 308 is increased, an affect to the combined resistance of the third supporting roller 304 and the secondary transfer roller 308 is controlled to be small. That is, to reduce an affect of increase in resistance of the secondary transfer roller 308 to the combined resistance of the third supporting roller 304 and the secondary transfer roller 308, it is necessary to design the resistance of the secondary transfer roller 308 such that, even when the resistance increases the secondary transfer roller 308, the increased resistance can be smaller than the resistance of the third supporting roller 304. Therefore, the secondary transfer roller 308 is designed such that an amount of increase in resistance thereof is within the single digits and the resistance of the secondary transfer roller 308 is designed to be lower than the resistance of the third supporting roller 304 by one point or more. By so doing, even when the resistance of the secondary transfer roller 308 increases, an effect of the increased resistance to the combined resistance of the third supporting roller 304 and the secondary transfer roller 308 can be reduced.

For example, it is assumed that a resistance of the external roller (i.e., the secondary transfer roller 308) increases 5 times and a resistance of an internal roller (i.e., the third supporting roller 304 increases 2 times, and combined resistance values with different resistances are obtained. Table 3 shows results of the above-described tests. According to Table 3, it is clear that, the smaller the resistance of the external roller is than the resistance of the internal roller, the smaller the increase amount of the combined resistance of the external roller and the internal roller become.

TABLE 3

| Internal Roller 2 × Amount of Increase | External Roller 5 × Amount of Increase | Composite Resistance Index Display | Composite Resistance Common Logarithm Value |
|---|---|---|---|
| 1.0E+07 | 1.0E+05 | 2.1E+07 | 7.31 |
| 1.0E+07 | 1.0E+06 | 2.5E+07 | 7.40 |
| 1.0E+07 | 1.0E+07 | 7.0E+07 | 7.85 |
| 1.0E+06 | 1.0E+07 | 5.2E+07 | 7.72 |
| 2.0E+05 | 5.0E+07 | 5.0E+07 | 7.70 |

Figure 15:
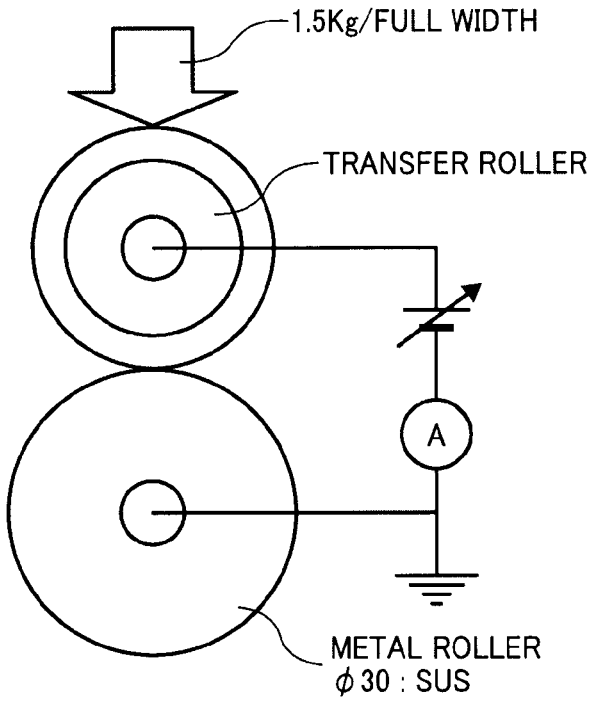
FIG. 15 is a schematic drawing for explaining a method of measuring roller resistance.

FIG. 15 is a schematic view illustrating a measuring unit for explaining a method of measuring a roller resistance.

The instrument includes an opposing metal roller, a high voltage power source, and an ammeter. The opposing metal roller is a stainless roller having a diameter ϕ of 30 mm, which is fixed by a bearing. A sample roller for measuring the resistivity is pressed at a force of 50 gf/cm against the opposing metal roller. A given voltage is applied by the high voltage power source (610D, manufactured by TREK JAPAN CO., LTD.) to a place between the opposing metal roller and a shaft of the sample roller to measure the current flowing the opposing metal roller and the sample roller using the ammeter (6514, manufactured by KEITHLEY INSTRUMENTS INC.). The high voltage power source and the ammeter are not limited to the above models. Further, it is more preferable to automatically input, store, and process the measured data via a personal computer. Therefore, in this exemplary embodiment, the measured data was automatically processed. The resistivity was measured under an environment condition at a temperature of 22 degrees Celsius and at a relative humidity of 55% RH.

Figure 16:
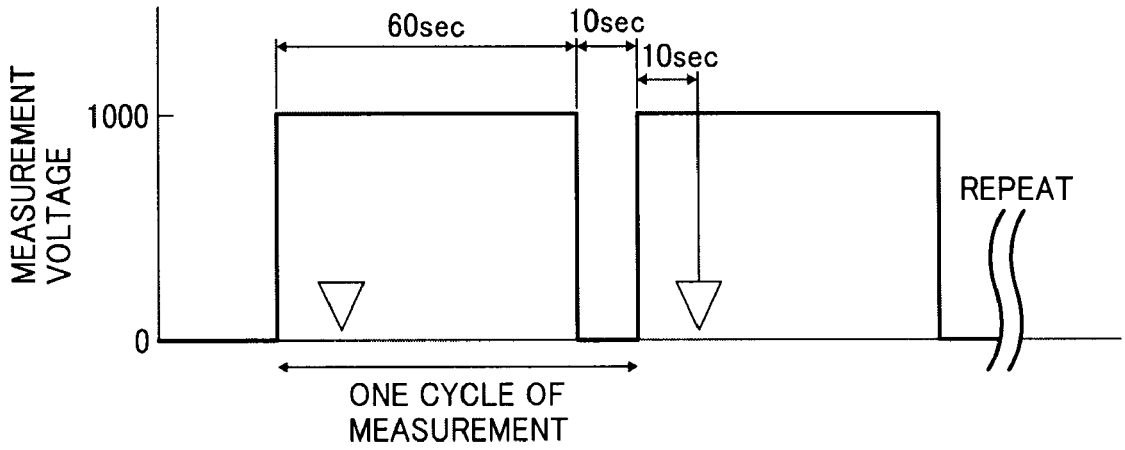
FIG. 16 is a schematic drawing for explaining a method of measuring roller conductive durability.

FIG. 16 is a schematic drawing for explaining a method of measuring conductive durability of a roller. The measurement is conducted by applying a set voltage for 60 seconds and removing electricity by grounding for 10 seconds in one cycle. This operation is repeatedly performed for given cycles as needed so as to evaluate the durability of conductivity of a roller. Quality in conductive durability is evaluated based on an amount of resistance change measured after 10 seconds of each cycle.

Figure 17:
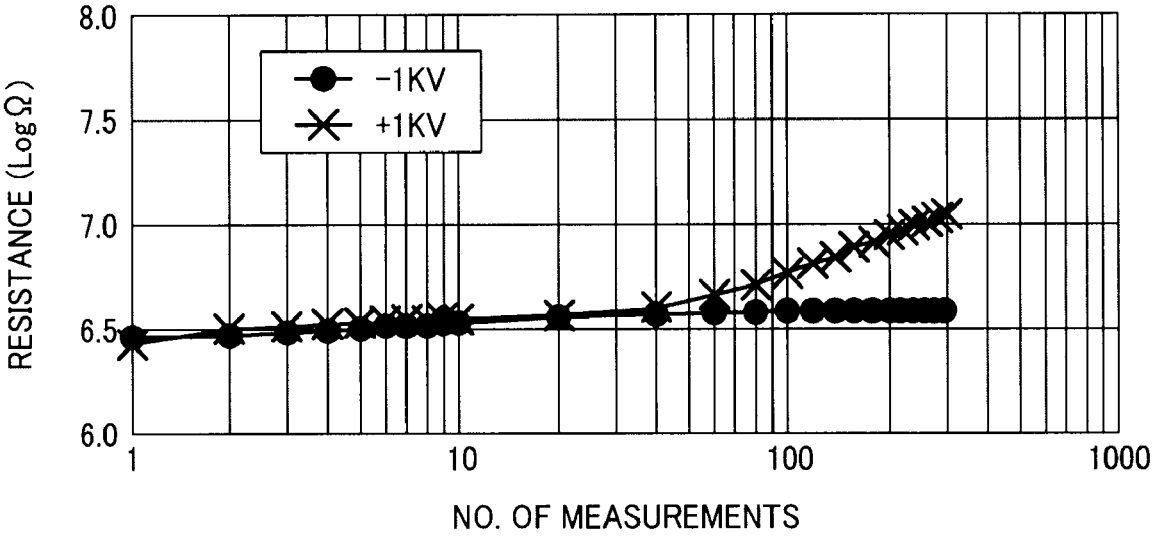
FIG. 17 is a graph showing resistance variation depending on polarity of voltage applied to a cored bar of a roller.

FIG. 17 is a graph showing resistance variation depending on polarity that is applied to a cored bar of a roller. It is clear that, an amount of increase when applying a positive polarity to a cored bar is greater than an amount of increase when applying a negative polarity. The reason of the above phenomenon is not clear. However, while the characteristic of this change can change due to an elastic material, conductive agent, etc., the resistance when applying a voltage having a positive polarity to the cored bar of a roller increases more than the resistance when applying a voltage having a negative polarity thereto.

Example 3

The secondary transfer roller 308 in Example 3 is a conductive roller including a foam ion with NBR rubber having an outer diameter ϕ of 16 mm, a cored bar having a diameter ϕ of 8 mm, and a hardness of 45 degrees in the asker C scale. The third supporting roller 304 is a solid ion conductive roller including an epichlorohydrin rubber and an acrylonitrile-butadiene rubber (NBR) having an outer diameter ϕ of 24 mm, and a hardness of 52 degrees in the asker A scale.

The durability of a roller was evaluated with a testing unit for single unit durability evaluation, which is a similar unit to the transfer unit 200. In the evaluation tests, a test for evaluating an increase in resistance of a roller was conducted continuously for 10 straight days under conditions similar to those using the transfer unit 200, substantially followed by a test for evaluating images in an image forming apparatus.

Further, voltage dependency of volume resistivity, which is described later, represents a difference between a 100V measurement resistance and a 10V measurement resistance.

Example 4

The procedure for measuring the resistivity of the external roller (the secondary transfer roller 308) and the internal roller (the third supporting roller 304) in Example 3 is repeated except that the resistance of the external roller is 5.5.

Example 5

In Example 5, the intermediate transfer belt 201 includes a two-layer belt formed by polyimide resin. An upper layer of the intermediate transfer belt 201 has a volume resistivity of 10.9 and a thickness of 40 μm and a base layer thereof has a volume resistivity of 9.5 and a thickness of 40 μm. The resistance of the external roller and the resistance of the internal roller are same as those in Example 4.

Example 6

In Example 6, the intermediate transfer belt 201 is formed by polyamide-imide resin and a surface layer thereof has a thickness of 2.6 μm. The procedure for manufacturing the intermediate transfer belt 201 is same as the intermediate transfer belt 201 formed by polyimide resin. The resistance of the external roller and the resistance of the internal roller are same as those in Example 4.

Comparative Example 1

The procedure for measuring the resistivity of the external roller (the secondary transfer roller 308) and the internal roller (the third supporting roller 304) in Example 3 is repeated except that the resistance of the external roller is 7.2 and the resistance of the internal roller is 6.5.

Comparative Example 2

The procedure for measuring the resistivity of the external roller (the secondary transfer roller 308) and the internal roller (the third supporting roller 304) in Example 3 is repeated except that the resistance of the internal roller is 6.5.

Comparative Example 3

The intermediate transfer belt 201 was molded through the inflation molding methods by using PVdF having ion conductive additive. Further, the resistance of the external roller is 5.5 and the resistance of the internal roller is 7.2.

[Evaluation]

Table 4 shows results of the tests on the above-described examples and comparative examples.

TABLE 4

| | | CE 1 | CE 2 | EX 3 | EX 4 | EX 5 | EX 6 | CE 3 |
|---|---|---|---|---|---|---|---|---|
| Resistance of surface layer material | | 12.8 | 12.8 | 12.8 | 12.8 | 10.9/9.5 | 12.8 | — |
| Surface layer thickness | | 1.8 | 1.8 | 1.8 | 1.8 | 40/40 | 2.6 | — |
| Volume Resistivity (ρv) | | 9.7 | 9.7 | 9.7 | 9.7 | 10.8 | 9.7 | 11.2 |
| Difference between amount of outer and inner surfaces (ρs) | | 0.31 | 0.31 | 0.31 | 0.31 | 0.75 | 0.45 | 0 |
| Material of ring-shaped member | | Polyimide | Polyimide | Polyimide | Polyimide | Polyimide | Polyamidimid | PVDF |
| Voltage dependency | | 1.7 | 1.7 | 1.7 | 1.7 | 2.1 | 1.9 | 0.5 |
| External roller resistance | Initial condition | 7.2 | 7.2 | 6.2 | 5.5 | 5.5 | 5.5 | 5.5 |
| Internal roller resistance | | 6.5 | 7 | 7.2 | 7.2 | 7.2 | 7.2 | 7.2 |
| External roller resistance | Condition with time | 7.90 | 7.90 | 6.90 | 6.30 | 6.30 | 6.30 | 6.30 |
| Internal roller resistance | | 6.70 | 7.30 | 7.50 | 7.50 | 7.50 | 7.50 | 7.50 |
| Ratio of change of voltage | | 4.44 | 3.84 | 2.27 | 2.08 | 2.08 | 2.08 | 2.08 |
| Rank on white spots | | 4.5 | 4.5 | 4.75 | 5 | 5 | 5 | 5 |
| Coarse image | | YES | YES | NO | NO | NO | NO | YES |

In Example 3, the difference between the amounts of resistivity changes of the outer and inner surfaces ρs of a ring-shaped surface layer formed by the polyimide resin was 0.31, the voltage dependency was 1.7, the initial resistance of the internal roller was 7.2, and the initial resistance of the external roller was 6.2, which was one point smaller than that of the internal roller. As a result of the continuous durability evaluation tests for 10 straight days, the resistance of the internal roller increased by 0.3 point to 7.5, and the resistance of the external roller increased by 0.7 point to 6.9. Further, the ratio of increase in transfer voltage increased by 2.27 times, which was about half the amount of increase as 4.44 times of Comparative Example 1 and 3.84 times of Comparative Example 2, and therefore the voltage that was around 2 kV at the initial stage was reduced to 5 kV or below. Accordingly, the results of Example 3 were not affected by electrical discharge due to an increase in voltage and limitation of voltage due to an upper limit voltage, an occurrence of poor transferability was avoided, and the result of occurrence of white spots was ranked 4.75, which was good in image quality.

In Comparative Example 1, the resistance of the external roller was set higher than the resistance of the internal roller, which increased the ratio of increase of transfer voltage by 4.44 times, as shown in the evaluation results of durability of conductivity. Therefore, the voltage that was 2 kV at the initial stage increased up to 9 kV, which generated poor transferability caused by limitation of voltage due to the upper limit voltage, and resulted in a production of coarse images.

In Comparative Example 2, the resistance of the external roller was set higher than the resistance of the internal roller, which increased the ratio of increase of transfer voltage by 3.84 times, as shown in the evaluation results of durability of conductivity. Therefore, the voltage that was 2 kV at the initial stage increased up to 7 kV, which generated poor transferability caused by limitation of voltage due to the upper limit voltage, and resulted in a production of coarse images.

In Comparative Example 3, the voltage dependency was small and no white spots appeared. However, the resistance dropped significantly under a high humid condition, and therefore the electric field of transfer reduced sharply, which produced coarse images.

As described above, according to the above-described exemplary embodiments, it has been proved by the above-described tests that the intermediate transfer belt 201 that serves as a multi-layer endless belt member having a high-resistance surface layer to be used for an image forming apparatus can reduce an occurrence of toner scattering and an image having white spots when setting the above-described conditions such that the volume resistivity of the intermediate transfer belt 201 ranges from 8.0 to 11.0 in a common logarithm value (log [Ω·cm]), and that the amount of resistivity change of the outer surface of the intermediate transfer belt 201 is greater than the amount of resistivity change of the inner surface of the intermediate transfer belt 201 by 0.05 or more in a common logarithm value (log [Ω/square]), where the amount of resistivity change of the outer surface indicates a difference between a surface resistivity value measured after a given voltage is applied for 1 second and a surface resistivity value measured after a given voltage is applied for 100 seconds on the outer surface of the endless intermediate transfer belt 201, and the amount of resistivity change of the inner surface indicates a difference between a surface resistivity value measured after a given voltage is applied for 1 second and a surface resistivity value measured after a given voltage is applied for 100 seconds on the inner surface of the endless intermediate transfer belt 201.

Further, according to the above-described exemplary embodiments, it has been proved by the above-described tests that, when the difference between the amounts of resistivity change of the above-described outer and inner surfaces is 1.0 or less in the common logarithm value (log [Ω/square]), an occurrence of the lateral or horizontal white banding can be prevented.

Further, according to the above-described exemplary embodiments, when the respective volume dependencies of volume resistivity measured at 10V and 100V of the intermediate transfer belt 201 is 1.5 or greater in the common logarithm value (log [Ω·cm]), high electrostatic stability can be obtained and occurrences of toner scattering around text and white spots with time and under a given environmental condition can be prevented.

Further, according to the above-described exemplary embodiments, when the intermediate transfer belt 201 includes a polyamide resin or a polyamide-imide resin, high electrostatic stability can be obtained with time and under a given environmental condition and enhance durability/quality, and occurrences of toner scattering around text and white spots can be prevented.

Further, according to the above-described exemplary embodiments, the transfer unit 200 includes the intermediate transfer belt 201 that corresponds to the multi-layer endless belt member to temporarily transfer a toner image formed on the photoconductor 102 thereto. When a belt member according to the present invention employs the intermediate transfer belt 201, white spots and horizontal white banding cannot appear on an image.

Further, according to the above-described exemplary embodiments, the image forming apparatus 1 includes the photoconductor 102 that serves as an image carrier for carrying a latent image on the surface thereof, the developing unit 104 for developing the latent image into a toner image, the transfer unit 200 including the intermediate transfer belt 201 for temporarily transferring the toner image on the photoconductor 102 onto the intermediate transfer belt 201. When the transfer unit 200 includes the intermediate transfer belt 201 as the intermediate transfer member according to the above-described exemplary embodiments of the present invention, white spots and horizontal white banding cannot appear on an image.

Further, according to the above-described exemplary embodiments, the transfer unit 200 includes the secondary transfer roller 308 that serves as an external roller to contact a recording medium or transfer member against the outer surface of the intermediate transfer belt 201, and the third supporting roller 304 that serves as an internal roller disposed opposite or facing the secondary transfer roller 308 via the intermediate transfer belt 201. The secondary transfer roller 308 has a single layer structure. Even when using the secondary transfer roller 308 having such a single layer structure, which is low cost and does not require a separate cleaning unit, appropriate charge retention and electrostatic withstand voltage can reduce or prevent occurrences of toner scattering and white spots. This can provide the image forming apparatus 1 that can prevent fatigue of the photoconductor 102 caused due to excessive accumulation of charge at the interface of the base layer and the surface layer.

Further, according to the above-described exemplary embodiments, the resistance of the third supporting roller 304 is greater than the resistance of the secondary transfer roller 308. With the above-described configuration, even when the resistance of the secondary transfer roller 308 increases, the combined resistance of the third supporting roller 304 and the secondary transfer roller 308 may not increase significantly. Therefore, the above-described configuration can reduce occurrences of white spots and prevent failures such as abnormal electrical discharges due to an increase in applied voltage and a decrease in transferability due to limitation control.

Further, according to the above-described exemplary embodiments, the resistance of the third supporting roller 304 is greater than the resistance of the secondary transfer roller 308 by 1.0 or greater in the common logarithm value (log Ω). Therefore, occurrences of white spots can be reduced and an increase in resistance of the secondary transfer roller 308 may less contribute to an increase in the combined resistance of the third supporting roller 304 and the secondary transfer roller 308. Further, the above-described configuration can prevent failures such as abnormal electrical discharges due to an increase in applied voltage and a decrease in transferability due to limitation control.

Further, according to the above-described exemplary embodiments, the above-described method of evaluating a belt member is used to determine a specification of the intermediate transfer belt 201 serving as an endless belt member having a multi layer structure with a high-resistance surface layer. The method uses the difference between the amounts of resistivity change of the outer and inner surfaces and the volume resistivity of the intermediate transfer belt 201 to evaluate the intermediate transfer belt 201, where the amount of resistivity change of the outer surface indicates a difference between a surface resistivity value measured after a given voltage is applied for 1 second and a surface resistivity value measured after a given voltage is applied for 100 seconds on the outer surface of the endless intermediate transfer belt 201, and the amount of resistivity change of the inner surface indicates a difference between a surface resistivity value measured after a given voltage is applied for 1 second and a surface resistivity value measured after a given voltage is applied for 100 seconds on the inner surface of the endless intermediate transfer belt 201. Specifically, the method of evaluating the belt member obtains the amount of resistivity change of the outer surface of the intermediate transfer belt 201, the amount of resistivity change of the inner surface thereof, calculates the difference between the amounts of resistivity changes of the outer and inner surfaces thereof, obtains the volume resistivity of the intermediate transfer belt 201, and, by using the difference between the amounts of resistivity change of the outer and inner surfaces and the volume resistivity of the intermediate transfer belt, determines whether the volume resistivity thereof ranges from 8.0 to 11.0 and whether the amount of resistivity change of the outer surface thereof is greater than the amount of resistivity change of the inner surface thereof by 0.05 or more in a common logarithm value (log [Ω/square]). With these values for evaluation, it can determine whether an intermediate transfer belt prevents toner scattering and white spots.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A multi-layer endless belt member for use in an image forming apparatus and including a volume resistivity and a surface resistivity, the multi-layer endless belt member comprising:

a base layer having a resistance;

a surface layer having a resistance higher than the resistance of the base layer, the surface layer for carrying a toner image thereon, wherein:

the volume resistivity of the multi-layer endless belt ranges from approximately 8.0 to approximately 11.0 in a common logarithm value (log [Ω·cm]), the multi-layer endless belt member has a resistivity on a first surface which is an outer surface of the surface layer of the multi-layer endless belt member and a resistivity on a second surface which is as an inner surface of the base layer of the multi-layer endless belt member, and an amount of resistivity change of the first surface of the multi-layer endless belt member is greater than an amount of resistivity change of the second surface of the multi-layer endless belt member, where the amount of resistivity change of the first surface indicates a difference between a surface resistivity value measured after a given voltage is applied for 1 second and a highest surface resistivity value measured after the given voltage is applied between 1 second and up to and including 100 seconds on the first surface of the multi-layer endless belt member; and the amount of resistivity change of the second surface indicates a difference between a surface resistivity value measured after the given voltage is applied for 1 second and a highest surface resistivity value measured after the given voltage is applied between 1 second and up to and including 100 seconds on the second surface of the multi-layer endless belt member.

2. The multi-layer endless belt member according to claim 1, wherein the difference between the amount of resistivity change of the first surface and the amount of resistivity change of the second surface is 0.05 or more in a common logarithm value (log [Ω/square]).

3. The multi-layer endless belt member according to claim 1, wherein the difference between the amount of resistivity change of the first surface and the amount of resistivity change of the second surface is 1.0 or less in the common logarithm value (log [Ω/square]).

4. The multi-layer endless belt member according to claim 1, wherein a difference between the amount of resistivity change of the first surface and the amount of resistivity change of the second surface is 1.0 or less in the common logarithm value (log [Ω/square]) which prevents white banding in the image forming apparatus.

5. The multi-layer endless belt member according to claim 1, wherein a material of the multi-layer endless belt member is one of a polyimide and a polyamide-imide.

6. A transfer unit, comprising:

the multi-layer endless belt according to claim 1, configured to serve as an intermediate transfer member to temporarily transfer a toner image formed on an image carrier thereto.

7. An image forming apparatus, comprising:

an image carrier configured to carry a latent image on a surface thereof;

a developing unit configured to develop the latent image formed on the surface of the image carrier into a toner image; and the transfer unit according to claim 6.

8. The image forming apparatus according to claim 7, wherein the transfer unit includes an external roller and an internal roller, the external roller having a single layer structure and being configured to contact a recording medium against the first surface of the multi-layer endless belt member, the internal roller facing the external roller via the intermediate transfer belt.

9. The image forming apparatus according to claim 8, wherein a resistance of the internal roller is greater than a resistance of the external roller.

10. The image forming apparatus according to claim 9, wherein the resistance of the internal roller is greater than the resistance of the external roller by 1.0 or greater in units of a common logarithm value (log [Ω]).

11. The multi-layer endless belt member according to claim 1, wherein the resistance of the surface layer is at least 8.5 (log [Ω/square]).

12. The multi-layer endless belt member according to claim 1, wherein the resistance of the surface layer is at least 11 (log [Ω/square]).

13. A method of evaluating a multi-layer endless belt member with a surface layer for use in an image forming apparatus, the method of evaluating the multi-layer endless belt member comprising:

obtaining an amount of resistivity change of a first surface serving as an outer surface of the multi-layer endless belt member indicating a difference between a surface resistivity value measured after a given voltage is applied for 1 second and a highest surface resistivity value measured after the given voltage is applied between 1 second and up to and including 100 seconds on the first surface;

obtaining an amount of resistivity change of a second surface serving as an inner surface of the multi-layer endless belt member indicating a difference between a surface resistivity value measured after the given voltage is applied for 1 second and a highest surface resistivity value measured after the given voltage is applied between 1 second and up to and including 100 seconds on the second surface;

calculating a difference between the amount of resistivity change of the first surface and the amount of resistivity change of the second surface;

obtaining a volume resistivity of the multi-layer endless belt member; and determining that the multi-layer endless belt member is acceptable when the volume resistivity of the multi-layer endless belt member ranges from 8.0 to 11.0 and when the amount of resistivity change of the first surface thereof is greater than the amount of resistivity change of the second surface thereof by 0.05 or more in a common logarithm value (log [Ω/square]).

* * * * *